US008655203B2

(12) United States Patent
Komatsu

(10) Patent No.: US 8,655,203 B2
(45) Date of Patent: Feb. 18, 2014

(54) TONER SUPPLY CONTROL SYSTEM AND METHOD FOR IMAGE FORMING APPARATUS

(75) Inventor: Makoto Komatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 13/207,770

(22) Filed: Aug. 11, 2011

(65) Prior Publication Data

US 2012/0051760 A1 Mar. 1, 2012

(30) Foreign Application Priority Data

Aug. 25, 2010 (JP) ..... 2010-187908

(51) Int. Cl.
*G03G 15/08* (2006.01)

(52) U.S. Cl.
USPC ..... 399/30; 399/27

(58) Field of Classification Search
USPC ..... 399/27, 30
See application file for complete search history.

(56) References Cited

U.S. PATENT DOCUMENTS

| | | | | |
|---|---|---|---|---|
| 6,941,096 | B2 | 9/2005 | Matsuda et al. | |
| 6,949,896 | B2 | 9/2005 | Andoh et al. | |
| 6,996,357 | B2 | 2/2006 | Matsuda et al. | |
| 7,576,509 | B2 | 8/2009 | Komatsu et al. | |
| 7,579,795 | B2 | 8/2009 | Komatsu et al. | |
| 7,696,713 | B2 | 4/2010 | Komatsu et al. | |
| 7,831,185 | B2 | 11/2010 | Masubuchi et al. | |
| 7,907,872 | B2 | 3/2011 | Komatsu et al. | |
| 2008/0175612 | A1 | 7/2008 | Oikawa et al. | |
| 2008/0232880 | A1 | 9/2008 | Noguchi et al. | |
| 2008/0240760 | A1* | 10/2008 | Tanaka | 399/62 |
| 2008/0273885 | A1* | 11/2008 | Koizumi et al. | 399/30 |
| 2008/0303202 | A1 | 12/2008 | Noguchi et al. | |
| 2009/0060613 | A1 | 3/2009 | Matsuda et al. | |
| 2009/0322020 | A1 | 12/2009 | Iwata et al. | |
| 2010/0119264 | A1 | 5/2010 | Yamaguchi et al. | |
| 2011/0064478 | A1 | 3/2011 | Yamaguchi et al. | |

FOREIGN PATENT DOCUMENTS

| | | |
|---|---|---|
| JP | 2010-91784 | 4/2010 |
| JP | 2010-91785 | 4/2010 |

* cited by examiner

*Primary Examiner* — Sandra Brase
(74) *Attorney, Agent, or Firm* — Oblon, Spivak, McClelland, Maier & Neustadt, L.L.P.

(57) ABSTRACT

A toner supply control system for an image forming apparatus includes a supply controller to compute a toner supply amount required for a toner supply operation to cancel a toner concentration fluctuation in the developing agent. The supply controller includes an image-information-based consumption prediction unit to predict toner consumption amount based on image information used for forming an image; a toner-concentration-based consumption prediction unit to predict toner consumption amount based on a detection result of a toner concentration detector; and a toner supply determination unit to determine a toner supply timing and amount and initiate a toner supply operation based on the toner consumption amount predicted by the toner-concentration-based consumption prediction unit right after the toner consumption occurs. When the toner-consumed developing agent comes to a toner supply area again after the toner consumption occurs, a toner supply operation is initiated using a toner amount computed based on the image information in view of the already supplied toner.

11 Claims, 15 Drawing Sheets

TOTAL FLUCTUATION OF TONER CONCENTRATION

TOTAL FLUCTUATION OF TONER CONCENTRATION

TOTAL FLUCTUATION OF TONER CONCENTRATION

TOTAL FLUCTUATION OF TONER CONCENTRATION

TOTAL FLUCTUATION OF TONER CONCENTRATION

TOTAL FLUCTUATION OF TONER CONCENTRATION

TONER SUPPLY CONTROL SYSTEM AND METHOD FOR IMAGE FORMING APPARATUS

CROSS-REFERENCE TO RELATED APPLICATIONS

This application claims priority to Japanese Patent Application No. 2010-187908, filed on Aug. 25, 2010 in the Japan Patent Office, which is incorporated by reference herein its entirety.

BACKGROUND OF THE INVENTION

1. Field of the Invention

The present invention relates to a toner supply control system and method for an image forming apparatus having a development unit using a two-component developing agent.

2. Description of the Background Art

When image forming apparatuses form images using a developing agent having toner therein, it is important to maintain the toner concentration at a given level or range in a development unit to form images with high quality consistently.

The toner supply operation for image forming apparatuses can be mainly determined by two factors: image information to be output and environmental conditions. The image information such as print information directly relates to the toner amount to be consumed when outputting images, and the toner supply operation can be conducted with high precision in view of the output image information. However, because the toner is composed of powder particles, it is difficult to supply an exact amount of toner when supplying the toner. Further, the toner supply amount may fluctuate from one apparatus to another. Environmental conditions information such as temperature, humidity, and user settings need to be considered to secure the desired image quality, in which a toner sensor can be used to detect the toner concentration in a developing agent, and the toner supply operation can be conducted in view of a detection result of the toner sensor.

Conventional approaches employing feedback (FB) control or a combination of FB and feed forward (FF) control to compute the appropriate toner replenishment amount based on the output image information, although generally successful, either fail to effectively maintain the toner concentration at the proper level due to lack of a toner concentration sensor or have problems adjusting the timing of the delivery of replenished toner.

Moreover, although the toner supply operation can be conducted when the output image information is used for computing the toner supply amount because the output image information directly relates to the toner amount to be consumed by an image forming operation, and the toner consumption amount can be effectively computed with a higher precision compared to toner concentration detection by the toner concentration detector, the toner supply operation needs to be conducted more precisely.

SUMMARY

In one aspect of the invention, a toner supply control system for an image forming apparatus is devised. The image forming apparatus includes a latent image carrier; a latent image forming device to form a latent image on the latent image carrier; and a development device to develop the latent image formed on the latent image carrier using a developing agent. The development device includes a developing agent transporting device to transport the developing agent along a developing agent circulation route, a developing agent carrying device to carry the developing agent, circulating in the developing agent circulation route, on a surface of the developing agent carrying device, and to transport the developing agent to a development area facing the latent image carrier, and to return the developing agent passing the development area to the developing agent circulation route again; and a toner supply device to supply toner to the developing agent circulating in the developing agent circulation route from a toner supply area set at a given position of the developing agent circulation route by driving a toner supply member using a drive force of a drive source. The toner supply control system to control a toner supply for the development device includes a toner concentration detector, disposed at a position downstream in a transporting direction of the developing agent with respect to the toner supply area where the toner supply device supplies toner to the developing agent to detect toner concentration of the developing agent; and a supply controller to compute and adjust a toner supply amount value required for a toner supply operation to cancel a toner concentration fluctuation in the developing agent. The supply controller includes an image-information-based consumption prediction unit to predict toner consumption amount based on image information used for forming an image by the latent image forming device; a toner-concentration-based consumption prediction unit to predict toner consumption amount based on a detection result of the toner concentration detector; and a toner supply determination unit to determine a toner supply timing and a toner supply amount and initiate a toner supply operation based on the toner consumption amount predicted by the toner-concentration-based consumption prediction unit right after the toner consumption occurs. When the developing agent, containing consumed toner corresponding to the image information, comes to the toner supply area of the toner supply device again after the toner consumption occurs, the toner supply determination unit initiates a toner supply operation using a toner supply amount computed by using the toner consumption amount predicted by the image-information-based consumption prediction unit in view of the toner consumption amount predicted by the toner-concentration-based consumption prediction unit.

In another aspect of the invention, another toner supply control system for an image forming apparatus is devised. The image forming apparatus includes a latent image carrier; a latent image forming device to form a latent image on the latent image carrier; and a development device to develop the latent image formed on the latent image carrier using a developing agent. The development device includes a developing agent transporting device to transport the developing agent along a developing agent circulation route; a developing agent carrying device to carry the developing agent, circulating in the developing agent circulation route, on a surface of the developing agent carrying device, and to transport the developing agent to a development area facing the latent image carrier, and to return the developing agent passing the development area to the developing agent circulation route again; and a toner supply device to supply toner to the developing agent circulating in the developing agent circulation route from a toner supply area set at a given position of the developing agent circulation route by driving a toner supply member using a drive force of a drive source. The toner supply control system to control a toner supply to the development device includes a toner concentration detector disposed at a position downstream in a transporting direction of the developing agent with respect to the toner supply area where the toner supply device supplies toner to the developing agent to detect a toner concentration of the developing agent; and a supply controller to compute and adjust a toner supply amount value required for a toner supply operation to cancel a toner concentration fluctuation in the developing agent. The supply controller includes an image-information-based consumption prediction unit to predict toner consumption amount based on image information used for forming an image by the latent image forming device; a toner-concentration-based consumption prediction unit to predict toner consumption amount based on a detection result of the toner concentration detector; and a toner supply determination unit to determine a toner supply timing and a toner supply amount. The toner supply determination unit initiates a toner supply operation based on a toner consumption amount predicted by the toner-concentration-based consumption prediction unit at a timing right after the toner consumption occurs. The toner supply determination unit initiates a toner supply operation using a toner supply amount, based on a toner consumption amount corresponding to partial image information at the timing right after the toner consumption occurs. The toner supply determination unit initiates a toner supply operation by computing the a toner supply amount, corresponding to the remaining image information with respect to the partially image information in view of the toner supply amount corresponding to the toner consumption amount predicted by the toner-concentration-based consumption prediction unit when the developing agent, containing consumed toner corresponding to the image information, comes to the toner supply area of the toner supply device for the second time after the toner consumption occurs.

In another aspect of the invention, a method of controlling a toner concentration of a developing agent in an image forming apparatus is devised. The method includes the steps of a) detecting a toner concentration of a developing agent in a development device by using a toner concentration detector; b) computing a toner supply amount value using feedback (FB) control in response to the toner concentration detected at the a) detecting step; c) conducting a feedback-based toner supply operation using the toner supply amount value computed at the b) computing step; d) storing the toner supply amount value determined by the FB control in a memory; e) receiving image information to be used for an image forming operation; f) determining whether a toner supply operation to cancel, at least partially, a toner concentration fluctuation of the developing agent caused by a toner consumption, can be conducted using the image information partially, right after the toner consumption occurs; g) computing a toner supply amount value for the toner supply operation if the f) determining step determines that the toner supply operation to cancel, at least partially, the toner concentration fluctuation of the developing agent, can be conducted using the image information partially, right after the toner consumption occurs; h) conducting the toner supply operation using the toner supply amount value computed at the g) computing step right after the toner consumption occurs if the f) determining step determines that the toner supply operation using the image information partially can be conducted right after the toner consumption occurs; i) confirming a timing that the developing agent, being circulated in the development device with a toner consumed condition, comes to a toner supply area of the development device again after the toner consumption occurs; j) computing a toner supply amount value to cancel out the toner concentration fluctuation of the developing agent based on the image information received at the e) receiving step, and the toner supply amount value computed by using FB control at the b) computing step, and the toner supply amount value computed at the g) computing step if the g) computing step is conducted; and k) conducting a toner supply operation using the toner supply amount value computed at the j) computing step when the i) confirming steps confirms that the developing agent comes to the toner supply area of the development device again after the toner consumption occurs.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1A:
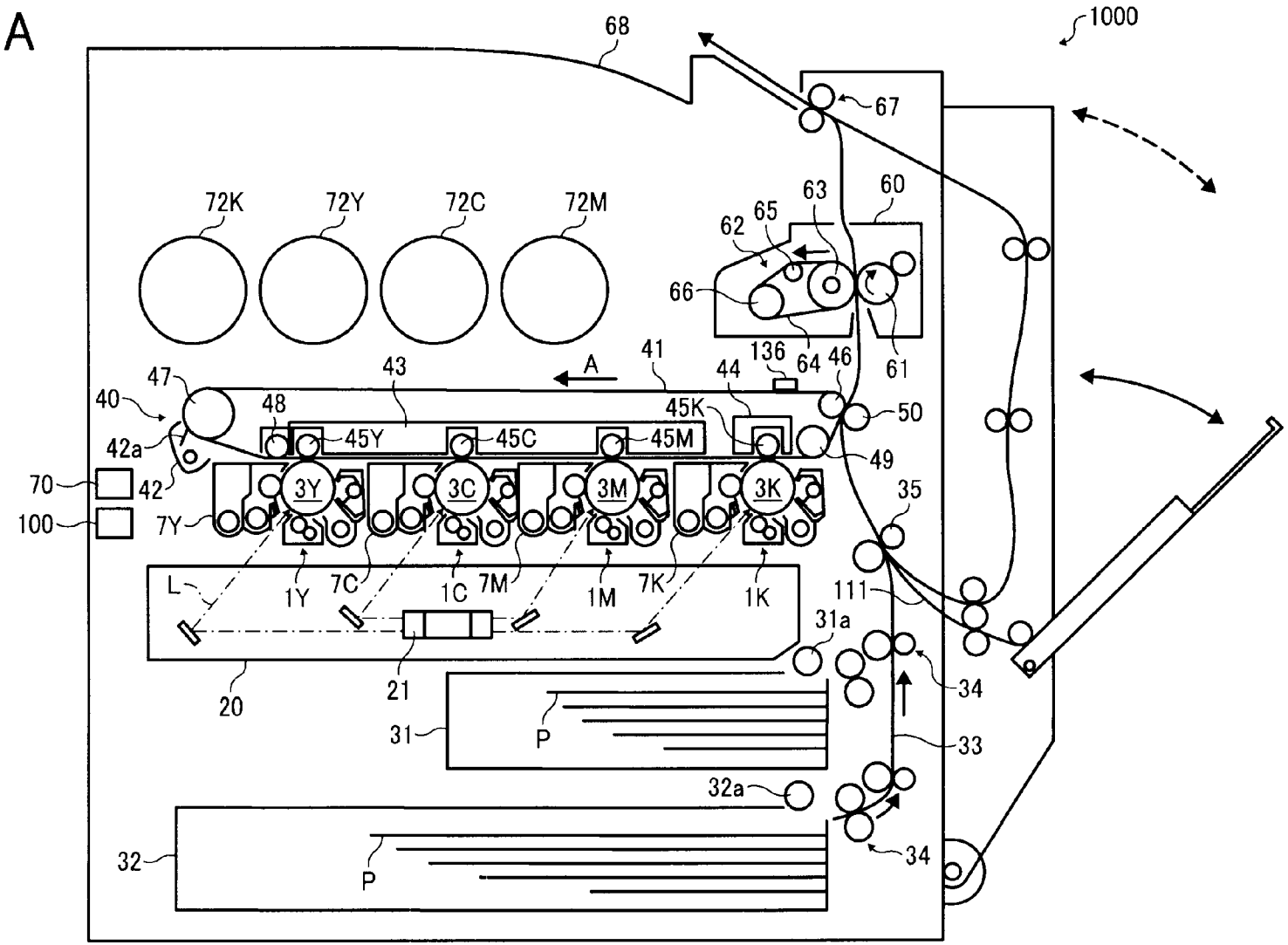
FIG. 1A shows a schematic configuration of a toner supply control system for an image forming apparatus according to an example embodiment, in which a toner supply control device is disposed in the image forming apparatus.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner.

Referring now to the drawings, a toner control system for an image forming apparatus, which can be used with a network, according to example embodiment is described hereinafter.

FIG. 1A shows a schematic configuration of an image forming apparatus 1000 according to an exemplary embodiment. The image forming apparatus 1000 may be used a printer using electrophotography, but not limited thereto. As shown in FIG. 1A, the image forming apparatus 1000 includes process cartridges 1Y, 1C, 1M, and 1K for forming toner images of yellow, magenta, cyan, black respectively. In this disclosure, the suffix letters of Y, M, C, and K attached to devices or the like for respectively indicating colors of yellow (Y), magenta (M), cyan (C), and black (K), and such suffix letters may be omitted when several devices or like may function substantially similar manner for the simplicity of expression. The process cartridges 1Y, 1C, 1M, and 1K have a similar configuration one another except toner colors of Y, C, M, and K toner.

Figure 2:
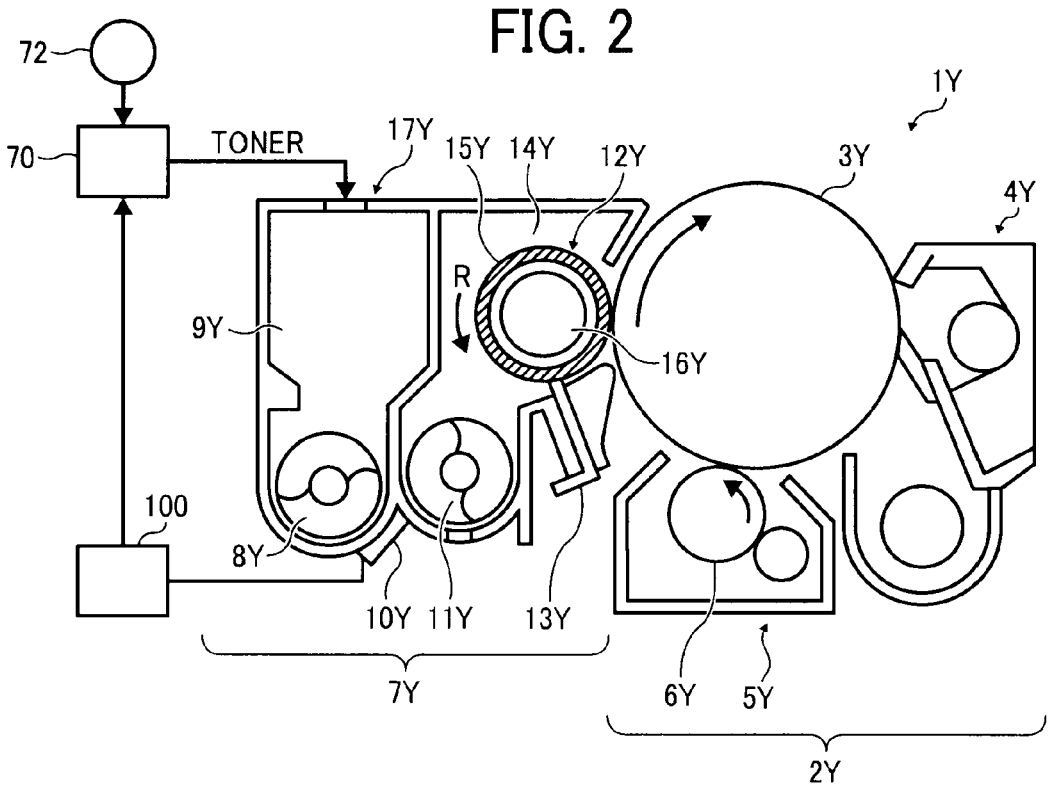
FIG. 2 shows a schematic configuration of a process cartridge disposed in the image forming apparatus according to an example embodiment.
Figure 3:
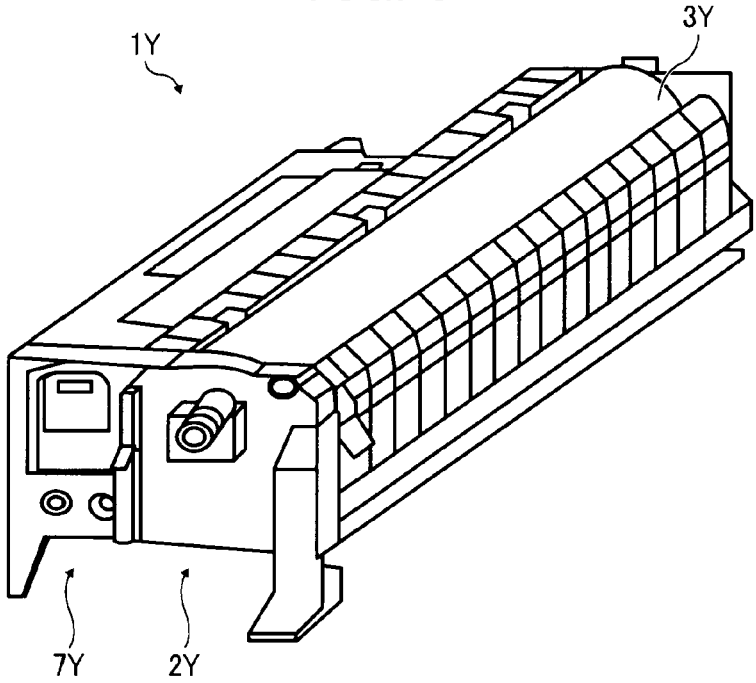
FIG. 3 shows a perspective view of the yellow toner process cartridge of FIG. 2.

FIG. 2 shows a schematic configuration of a process cartridge 1Y for forming Y toner image in FIG. 1A. FIG. 3 shows a perspective view of the process cartridge 1Y. As shown in FIG. 2, the process cartridge 1Y, which forms Y toner image, includes a photoconductor unit 2Y, and a development unit 7Y (useable as a development device). The process cartridge 1Y, integrating the photoconductor unit 2Y and the development unit 7Y, is detachably mountable to the image forming apparatus 1000. Further, the development unit 7Y is detachably mountable to the process cartridge 1Y when the process cartridge 1Y is removed from the image forming apparatus 1000. Accordingly, the photoconductor unit 2Y and the development unit 7Y can be separated from each other.

As shown in FIG. 2, the photoconductor unit 2Y includes a photoconductor 3Y, a drum cleaning unit 4Y, a charging unit 5Y, and a de-charging unit, for example. The photoconductor 3Y used as a latent image carrier has a drum shape, for example. The charging unit 5Y, which includes a charge roller 6Y, uniformly charges a surface of the photoconductor 3Y, rotating in a clockwise direction in FIG. 2 by a driving unit, to a given polarity, such as negative polarity. In FIG. 2, the charge roller 6Y, supplied with a charging bias voltage from a power source and rotating in a counter-clockwise direction in FIG. 2, uniformly charges the photoconductor 3Y. In such a configuration, the charge roller 6Y is disposed in proximity to the photoconductor 3Y. Instead of the charge roller 6Y, a charge brush may be used, for example. Further, the photoconductor 3Y can be uniformly charged using a non-contact charging method, such as a scorotron charger. After the charging unit 5Y uniformly charges a surface of the photoconductor 3Y, an optical writing device 20 (usable as a latent image forming device), to be described later, emits and scans a laser beam on the photoconductor 3Y to form an electrostatic latent image of Y image on the photoconductor 3Y.

Figure 4:
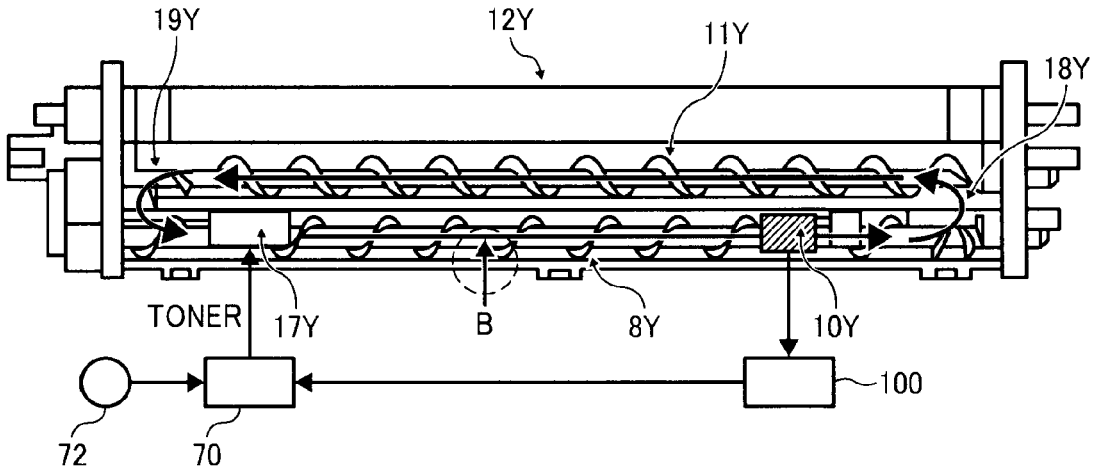
FIG. 4 shows a schematic cut view of a development unit of the yellow toner process cartridge of FIG. 2, showing a developing agent circulation route and its surroundings used for circulating the two-component developing agent in the development unit.

FIG. 4 shows a cut view of the development unit 7Y showing a developing agent circulation route and its surroundings used for circulating the two-component developing agent in the development unit 7Y. As shown in FIG. 2, the development unit 7Y includes a first compartment 9Y, and a second compartment 14Y. As shown in FIGS. 2 and 4, the first compartment 9Y includes, for example, a first transport screw 8Y and a toner concentration sensor 10Y. The toner concentration sensor 10Y may be a magnetic permeability sensor, for example. The toner concentration sensor 10Y may be referred to as a toner concentration detector or toner detector.

The second compartment 9Y includes, a second transport screw 11Y, a developing roller 12Y, and a doctor blade 13Y, for example. The doctor blade 13Y regulates an amount of developing agent on the developing roller 12Y. Y developing agent, mainly composed of magnetic carrier and Y toner charged to negative polarity, is stored in the first compartment 9Y and the second compartment 14Y. The second transport screw 11Y, driven by a driving unit, transports the Y developing agent in one direction in the second compartment 9Y. The Y developing agent transported to one end of the second compartment 14Y is moved to the first compartment 9Y via a communication port 19Y formed on a separation wall set between the second compartment 14Y and the first compartment 9Y. The developing roller 12Y is used as a developing agent carrying device. Each of the first transport screw 8Y and second transport screw 11Y is used as a developing agent transporting device.

The first transport screw 8Y, driven by a driving unit, transports the Y developing agent in another direction in the first compartment 9Y, wherein toner transport directions in the first compartment 9Y and the second compartment 14Y are opposite each other. The toner concentration sensor 10Y, disposed at a given position, such as a bottom side, of the first compartment 9Y, detects toner concentration in the Y developing agent. As shown in FIG. 4, the toner concentration sensor 10Y may be disposed at a downstream of the circulation direction of developing agent with respect to a toner supply port 17Y. The area around of the toner supply port 17Y may be referred to as a toner supply area. The Y developing agent, transported to the end of the first compartment 9Y by using first transport screw 8Y, enters the second compartment 14Y through a communication port 18Y.

As shown in FIG. 2, the developing roller 12Y is disposed over the second transport screw 11Y in a parallel manner. The developing roller 12Y includes a developing sleeve 15Y, and a magnet roller 16Y encased in the developing sleeve 15Y. The developing sleeve 15Y, made of a non-magnetic tube, can be rotated in a counter-clockwise direction R, as seen in FIG. 2, for example.

Some of the Y developing agent transported by the second transport screw 11Y is carried up to the developing sleeve 15Y with magnetic force generated by the magnet roller 16Y. The doctor blade 13Y, set at a given position while maintaining a given gap with the developing sleeve 15Y, regulates a thickness of Y developing agent on the developing sleeve 15Y. Then, the Y developing agent is transported to a development area facing the photoconductor 3Y, and Y toner is attracted to an electrostatic latent image of Y image on the photoconductor 3Y to develop a Y toner image on the photoconductor 3Y. The Y developing agent, which consumed Y toner by a developing process, is returned to the second transport screw 11Y with a rotation of the developing sleeve 15Y of the developing roller 12Y. The returned Y developing agent is transported in the first compartment 9Y, and then moved to the second compartment 14Y via a communication port set between the first compartment 9Y and the second compartment 14Y. As such, the developing agent can be circulated and transported in the first compartment 9Y and the second compartment 14Y of the development unit 7Y.

Figure 5:
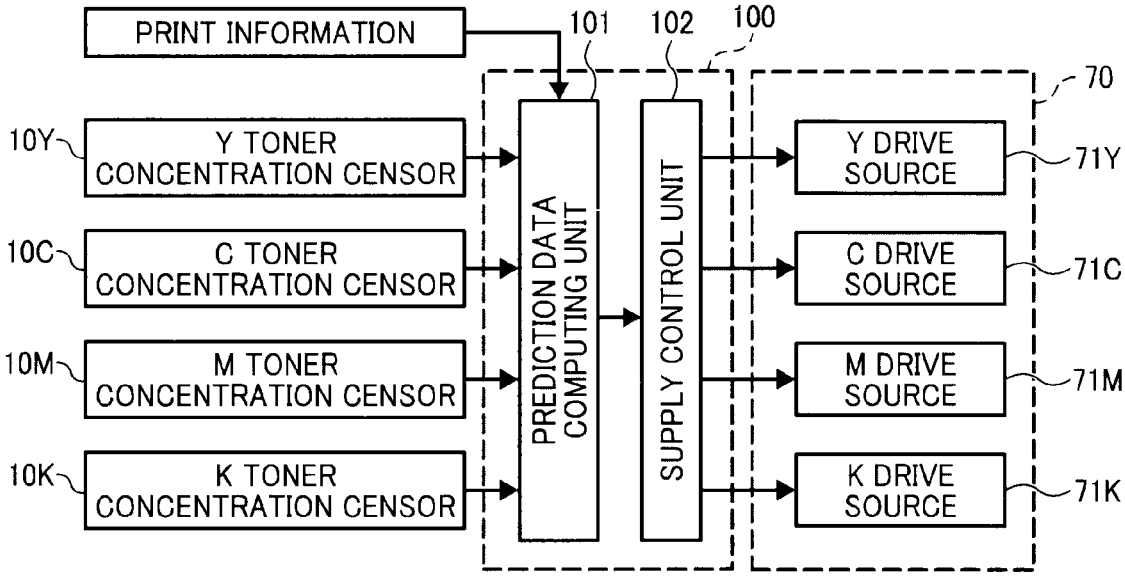
FIG. 5 shows a block diagram of toner supply control system according to an example embodiment.

FIG. 5 shows a block diagram of toner supply control according to an example embodiment. When the toner concentration sensor 10Y detects magnetic permeability of Y developing agent, the toner concentration sensor 10Y transmits a detection result to a control unit 100 as a voltage signal. Because the magnetic permeability of Y developing agent is correlated to Y toner concentration in the Y developing agent, the toner concentration sensor 10Y outputs a voltage signal corresponding to an actual Y toner concentration. The control unit 100 includes a central processing unit (CPU) used as a computing device, a random access memory (RAM) and read only memory (ROM) used as a data storage, or the like to conduct various types of operation processing and execution of control programs. The control unit 100 has a memory, which stores reference voltage data of Y Vtref, C Vtref, M Vtref, and K Vtref, used as target voltage for toner concentration of each of color. The memory may be a random access memory (RAM) or the like, but not limited to these. The control unit 100 can be configured using various types of processors, circuits, or the like such as a programmed processor, a circuit, an application specific integrated circuit (ASIC), used singly or in combination.

The control unit 100 compares an output voltage of the toner concentration sensor 10Y with the Y Vtref for the development unit 7Y, and activates a toner supply device 70Y for a given time computed from the data comparison. Specifically, a drive force of a Y drive source 71Y in the toner supply device 70 is controlled. With such activation for control, a given amount of fresh Y toner can be supplied to the first compartment 9Y from the toner supply port 17Y and mixed with the Y developing agent having low Y toner concentration due to Y toner consumption by a developing process. Accordingly, the Y toner concentration of Y developing agent in the second compartment 14Y can be maintained at a given level or range. Such toner concentration control is also conducted for other developing agents used in the development units 7C, 7M, and 7K of the process cartridges 1C, 1M, and 1K. The toner supply control according to example embodiments can cancel out toner concentration fluctuation as described later in this specification.

In the process cartridge 1Y, after the latent image forming process and the development process, the Y toner image is formed on the photoconductor 3Y, used as a latent image carrying member, and then transferred to an intermediate transfer belt 41 (endless belt) in a transfer unit 40, used a transfer apparatus. The drum cleaning unit 4Y (see FIG. 2) of the photoconductor unit 2Y removes toner remaining on the photoconductor 3Y after the transfer process to the intermediate transfer belt 41 (cleaning process). Then the surface of photoconductor 3Y, cleaned by the cleaning process, is decharged by the charging unit, by which the surface of photoconductor 3Y is ready for a next image forming operation. Similarly, the C toner image, M toner image, and K toner image can be formed on the photoconductors 3C, 3M, and 3K of the process cartridges 1C, 1M, and 1K, respectively, and then transferred to the intermediate transfer belt 41.

As shown in FIG. 1, an optical writing device 20 is disposed under the process cartridges 1Y, 1C, 1M, and 1K. The optical writing device 20 emits a laser beam L, based on image information, to the photoconductors 3Y, 3C, 3M, and 3K of the process cartridges 1Y, 1C, 1M, and 1K. With such laser beam irradiation, electrostatic latent images of Y, C, M, and K are formed on the photoconductors 3Y, 3C, 3M, and 3K, which are uniformly charged in advance by a charging process. The photoconductor 3 charged by a charging process has a given negative potential. When the laser beam is irradiated on such a charged photoconductor 3 for forming a latent image on the photoconductor 3, a latent image forming portion is set to another negative potential, which is lower than the given negative potential having no latent image. The optical writing device 20 includes a light source, a polygon mirror 21, a polygon motor, and a plurality of lenses and mirrors, for example. The laser beam L emitted from the light source is deflected by the polygon mirror 21 driven by the polygon motor, and passes a plurality of lenses and mirrors, and then scans the photoconductors 3Y, 3C, 3M, and 3K. Instead of such configuration, the optical writing device 20 may employ an LED (light emitting diode) array for scanning operation.

Returning to FIG. 1, a first sheet cassette 31 and a second sheet cassette 32 are disposed under the optical writing device 20 to store a given volume of recording medium P therein. A first feed roller 31*a* and a second feed roller 32*a* are pressed to a top sheet in the sheet cassettes 31 and 32. When the first feed roller 31*a* is driven by a driving unit in a counter-clockwise direction in FIG. 1, the top sheet in the first sheet cassette 31 is ejected to a sheet feed route 33 as the recording medium P. Further, when the second feed roller 32*a* is driven by a driving unit in a counter-clockwise direction, the top sheet in the second sheet cassette 32 is ejected to a sheet feed route 33 as the recording medium P. The sheet feed route 33 has a plurality of transport rollers 34 for transporting the recording medium P in the sheet feed route 33 in a given direction. As an alternative to using the sheet feed route 33, a sheet feed route 111 may be utilized.

At an end of the sheet feed route 33, a pair of registration rollers 35 is disposed. The registration rollers 35 sandwich the recording medium P by a pair of rollers and stops a rotation of rollers for a given time. Then, the registration roller 35 feeds the recording medium P to a secondary transfer nip, to be described later, at a given timing.

A transfer unit 40 is disposed over the process cartridges 1Y, 1C, 1M, and 1K, for example. The transfer unit 40 includes an intermediate transfer belt 41, a belt cleaning unit 42, a first bracket 43, a second bracket 44, primary transfer rollers 45Y, 45C, 45M, and 45K, a backup roller 46, a drive roller 47, a support roller 48, and a tension roller 49, for example. The intermediate transfer belt 41, extended by such rollers, can travel in a counter-clockwise direction shown by an arrow A endlessly when the drive roller 47 is driven, for example.

The primary transfer rollers 45Y, 45C, 45M, and 45K are disposed at an inner face side of the intermediate transfer belt 41 to press the intermediate transfer belt 41 to the photoconductors 3Y, 3C, 3M, and 3K. Such intermediate transfer belt 41 and the photoconductors 3Y, 3C, 3M, and 3K form a primary transfer nip therebetween. The primary transfer rollers 45Y, 45C, 45M, and 45K are supplied with a bias voltage having a polarity, opposite to a polarity of toner image. Specifically, because the toner image has a negative polarity, for example, a positive polarity is supplied to primary transfer rollers 45Y, 45C, 45M, and 45K, by which the intermediate transfer belt 41 is charged to a positive polarity, and a transfer electric field is generated around the primary transfer nip to transfer toner images from the photoconductors 3Y, 3C, 3M, and 3K to the intermediate transfer belt 41. Such Y, C, M, and K toner images are sequentially superimposed on the intermediate transfer belt 41 when the intermediate transfer belt 41 passes the primary transfer nip for Y, C, M, and K, by which a superimposed toner image is formed on the intermediate transfer belt 41.

The backup roller 46, a secondary transfer roller 50, and the intermediate transfer belt 41 set the secondary transfer nip. The registration roller 35 feeds the recording medium P to the secondary transfer nip at a given timing, synchronized to a formation of the superimposed toner image on the intermediate transfer belt 41.

The secondary transfer roller 50 is supplied with a secondary transfer bias voltage having a polarity, opposite to a polarity of the toner image, and the secondary transfer roller 50 applies such secondary transfer bias voltage to the intermediate transfer belt 41. With such configuration, a secondary transfer electric field is generated around the secondary transfer nip. The toner image is secondary transferred from the intermediate transfer belt 41 to the recording medium P with an effect of secondary transfer electric field and a nip pressure by the secondary transfer roller 50 and the backup roller 46, by which a full color toner image is formed on the recording medium P, which may be a white sheet (e.g., paper).

After such secondary transfer process, the belt cleaning unit 42 cleans toner remaining on the intermediate transfer belt 41 (i.e., toner not transferred to the recording medium P). The belt cleaning unit 42 may have a cleaning blade 42*a* pressed to the intermediate transfer belt 41 to remove toner from the intermediate transfer belt 41.

The first bracket 43 of the transfer unit 40 may pivot about the support roller 48 with a given angle range using a solenoid. When a monochrome image is formed by the image forming apparatus, the first bracket 43 may be pivoted in a counter-clockwise direction in FIG. 1 using the solenoid. With such pivoting operation, the primary transfer rollers 45Y, 45C, and 45M are pivoted about the support roller 48 with a given angle, by which the primary transfer rollers 45Y, 45C, and 45M and the intermediate transfer belt 41 are separated from the photoconductors 3Y, 3C, and 3M. Then, a monochrome image is formed by using only the process cartridge 1K. Because the process cartridges 1Y, 1C, and 1M are not activated when a monochrome image is formed by the image forming apparatus, a lifetime of the process cartridges 1Y, 1C, and 1M can be enhanced.

Further, a fixing unit 60 is disposed over the secondary transfer nip. The fixing unit 60 includes a heat/pressure roller 61, and a fixing belt unit 62. The heat/pressure roller 61 includes a heat source, such as for example halogen lamp. The fixing belt unit 62 includes a fixing belt 64, a heat roller 63 having a heat source (e.g., halogen lamp), a tension roller 65, a drive roller 66, and a temperature sensor, for example. The fixing belt 64, extended by the heat roller 63, the tension roller 65, and the drive roller 66, travels in a counter-clockwise direction in FIG. 1, for example. The fixing belt 64 can be heated by the heat roller 63 when the fixing belt 64 travels in a counter-clockwise direction. The heat/pressure roller 61, the heat roller 63, and the fixing belt 64 form a fixing nip therebetween. Specifically, the heat/pressure roller 61 rotating in a clockwise direction in FIG. 1 is pressed to the fixing belt 64 rotating in a counter-clockwise direction in FIG. 1 at the fixing nip, for example.

A temperature sensor is disposed above the fixing belt 64 with a given gap to detect surface temperature of the fixing belt 64 before entering the fixing nip. The detected surface temperature information is transmitted to a fixing power source unit. The fixing power source unit controls ON/OFF of power supply to the heat sources in the heat roller 63 and the heat/pressure roller 61 based on detected surface temperature information. With such configuration, the surface temperature of the fixing belt 64 may be maintained at a given temperature, such as about 140 degrees Celcius, for example.

After the secondary transfer process, the recording medium P is transported to the fixing unit 60, in which the full color toner image is fixed on the recording medium P by a nip pressure and heat of the fixing belt 64 at the fixing nip.

After such fixing process, the recording medium P is ejected out of the image forming apparatus by an ejection roller 67, and stacked on a stack tray 68 of the image forming apparatus, for example.

Further, toner cartridges 72Y, 72C, 72M, and 72K may be disposed over the transfer unit 40 to store Y, C, M, and K toner, respectively. By using the toner supply device 70, the Y, C, M, and K toner are respectively supplied from the toner cartridges 72Y, 72C, 72M, and 72K to the development units 7Y, 7C, 7M, and 7K of the process cartridges 1Y, 1C, 1M, and 1K at a given timing. The toner cartridges 72Y, 72C, 72M, and 72K are detachably mountable to the image forming apparatus, for example.

In the above description, the image forming apparatus 1000 is applied for a printer, but the image forming apparatus 1000 is not limited to the printer. For example, if a scanner to scan document images is disposed over the stack 68 (see FIG. 1), the image forming apparatus 1000 can be devised as a color copier. Further, if a communication device is added to the image forming apparatus 1000 to connect the image forming apparatus 1000 with an external network such as phone line network, optical network or with a local area network (LAN), the image forming apparatus 1000 can be devised as a facsimile machine, a digital multi-functional apparatus, which is generally known as a multi-functional peripherals (MFP). As such, the image forming apparatus 1000 can be devised as various types of apparatuses within a spirit of the present invention.

Figure 1B:
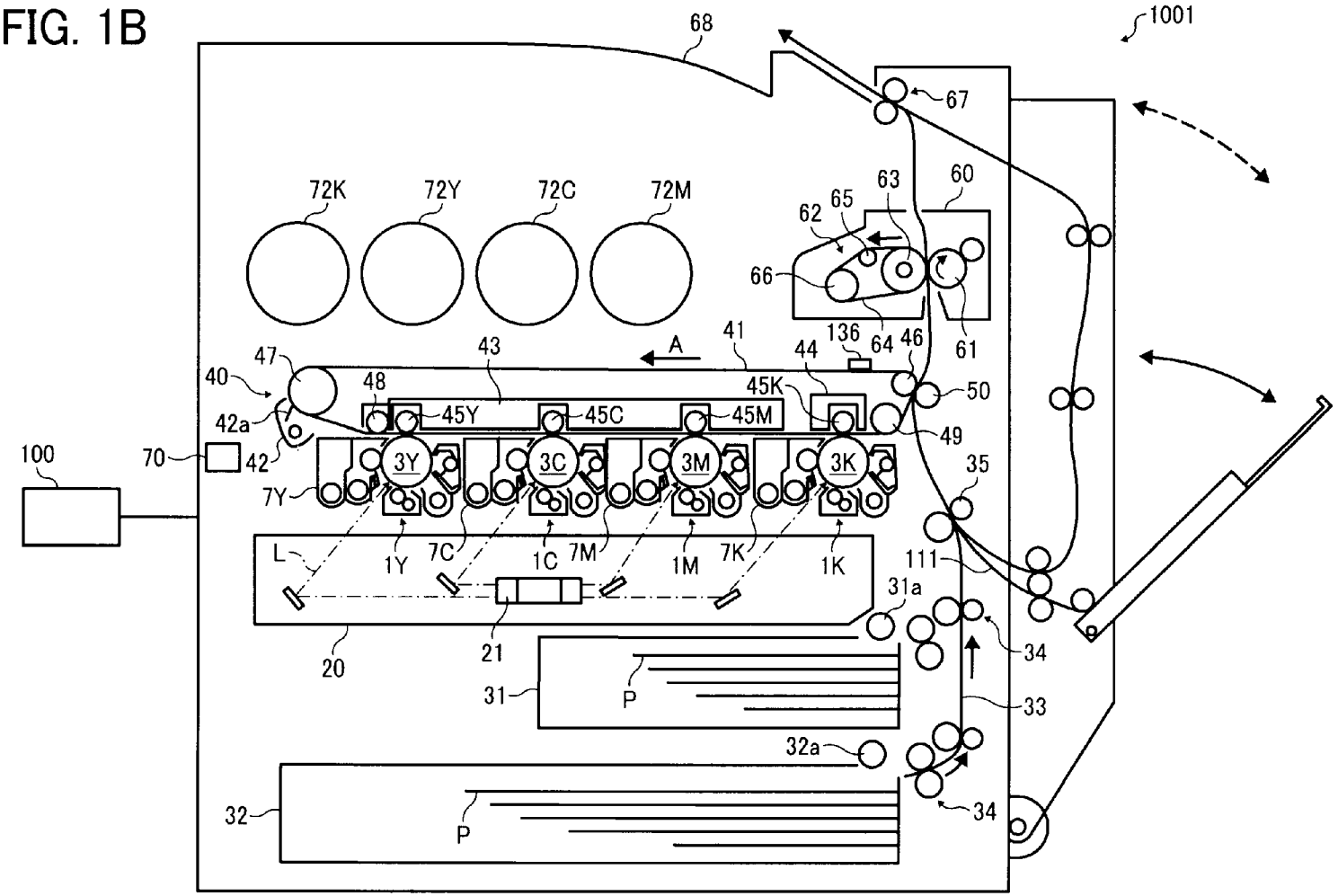
FIG. 1B shows a schematic configuration of a toner supply control system for an image forming apparatus according to an example embodiment, in which a toner supply control device is disposed outside of the image forming apparatus.
Figure 1C:
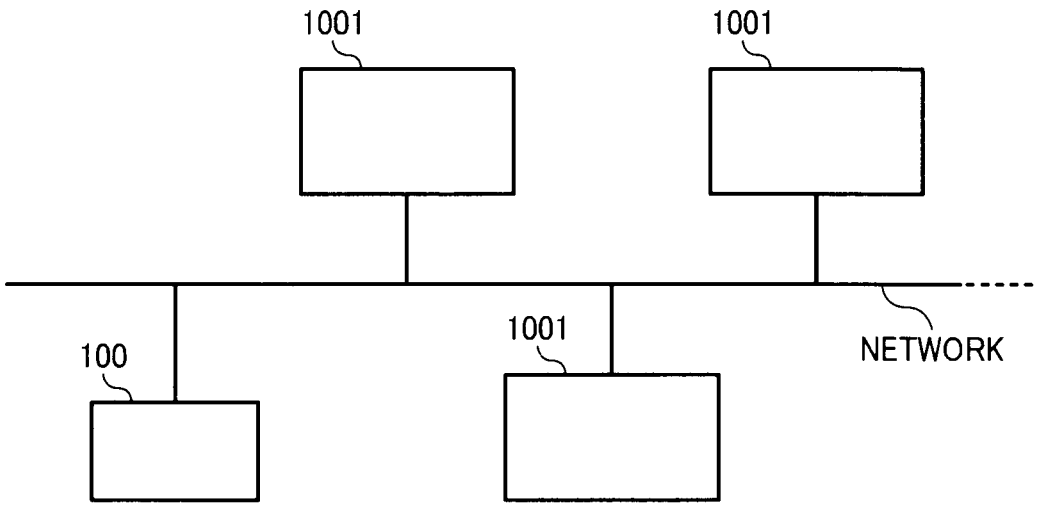
FIG. 1C shows a schematic configuration of a toner supply control system for one or more image forming apparatuses, connectable each other via a network, in which a toner supply control device is disposed outside of the image forming apparatuses and connectable to the image forming apparatuses via the network.

A description is now given of a toner supply control system according to an example embodiment of the present invention. Because the toner supply control system can be similarly conducted for each of colors, the toner supply control is explained using the Y toner supply control. The toner supply control system can be installed in the image forming apparatus 1000 as shown in FIG. 1A, or outside of an image forming apparatus 1001 using a separate device or apparatus, which may be referred to as an external device or apparatus, as shown in FIG. 1B. Further, the toner supply control system can be used for one or more of image forming apparatuses 1001 connectable each other via a network such as a local area network by disposing the toner supply control system and the image forming apparatuses 1001 on a network environment as shown in FIG. 1C.

As for the toner supply control system, the Y toner is supplied to the toner supply receiving area in the first compartment 9Y of the development unit 7Y through the toner supply port 17Y to maintain the toner concentration in the Y developing agent within a target range. In example embodiments, the Y toner is supplied from the toner supply port 17Y to the toner supply area facing the toner supply port 17Y, and then the Y toner is transported as the Y-developing agent to the second compartment 14Y disposed with the developing roller 12Y. In the second compartment 14Y, the Y developing agent can be supplied onto the developing roller 12Y.

As described later, the toner concentration in the Y developing agent may be measured or at a measurement area B, which may be set at a given position between the toner supply area of the first compartment 9Y and the upstream end side of the developing agent circulation direction of the second compartment 14Y. The toner supplied to the toner supply area can be adjusted to a given amount so that the toner concentration in the Y developing agent passing the measurement area B does not fluctuate along the timeline. The adjustment of toner amount at the toner supply area can be controlled by a supply control unit 102 (used as a supply controller) of the control unit 100 shown in FIG. 5, in which the supply control unit 102 controls a driving timing, a driving time duration, and a driving speed of a Y drive source 71Y that can drive one or more of toner supply members of the toner supply device 70 such as a screw, a powder-transport pump, or the like. The toner supply member driven by the Y drive source 71Y can adjust the toner amount supplied from the toner supply port 17Y to the Y developing agent. The measurement at the measurement area B may be conducted when designing, developing, manufacturing, and calibrating apparatuses to determine and set preferable toner concentration conditions for apparatuses, and such toner concentration conditions information can be used to determine a toner supplying amount and timing.

The control unit 100 includes a prediction data computing unit 101 to compute prediction data, and a supply control unit 102 to control the drive source 71 (e.g., Y drive source 71Y) of the toner supply device 70 based on the prediction data computed by the prediction data computing unit 101.

The prediction data computing unit 101 can compute prediction data of toner concentration in the developing agent using a detection result of the toner concentration sensor 10Y, image information to be output, and an operation program and an operation table stored in the ROM. Further, as described later, by detecting toner concentration at the measurement area B, the prediction data computing unit 101 can compute prediction data of toner concentration in the Y developing agent, which may fluctuate along the timeline at the measurement area B. Further, the prediction data computing unit 101 can compute prediction data of toner concentration in the Y developing agent, which may fluctuate along the timeline at the toner concentration sensor 10Y.

The supply control unit 102 in the control unit 100, function-able as a supply controller, controls the driving of the drive source 71 such as Y drive source 71Y to reduce, and in particular to cancel out the toner concentration fluctuation based on the prediction data computed by the prediction data computing unit 101, in which a combination of per-unit supply patterns, to-be-described later, are used. The per-unit supply patterns can be determined and obtained by conducting experiments.

A description is given of preparation process of per-unit supply patterns. In this disclosure, the per-unit means one printing operation, and the one printing operation may be one sheet printing per one printing operation, a ten-sheet printing per one printing operation, or the like. In this disclosure, the image information may mean information such as image area expressed by, for example, square centimeters or the like, a sheet size such as A4 size, a line speed of image forming expressed by, for example, millimeters per second or the like, color information such as monochrome and full colors, but not limited thereto.

In the experiment, a measurement sensor, which is different from the toner concentration sensor 10Y, is disposed as an experiment-purpose sensor at a position that can detect the toner concentration in the Y developing agent passing the measurement area B (see FIG. 4), which is the downstream side of circulation direction of developing agent with respect to the toner supply port 17Y in the first compartment 9Y. The experiment-purpose sensor used as the measurement sensor can function as similar to the toner concentration sensor 10Y. The measurement sensor and toner concentration sensor 10Y are used to measure one or more of basic patterns (hereinafter, basic supply patterns) of the toner supply operation conductable by the toner supply device 70.

Figure 6:
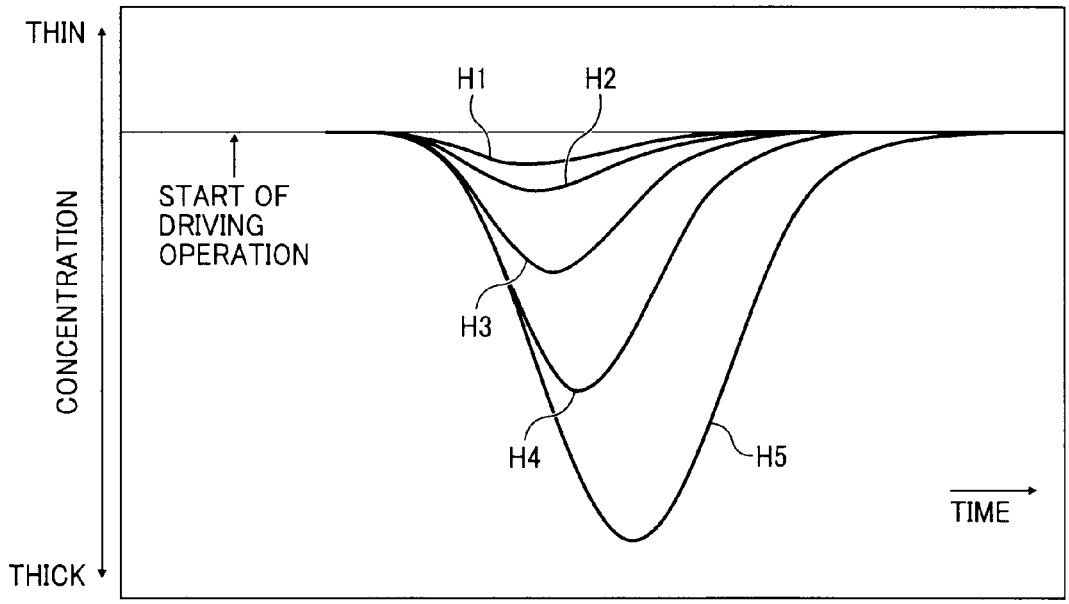
FIG. 6 shows profiles of basic toner supply patterns conductable by a toner supply device according to an example embodiment.

FIG. 6 shows example profiles of the basic supply patterns settable for the toner supply device 70 according to an example embodiment. The basic supply-patterns can be determined by conducting the toner supply operation of the Y developing agent having no toner concentration fluctuation, in which toner is supplied by one driving operation of the Y drive source 71Y (hereinafter, toner supply operation or supply operation) for a given amount, and then the measurement sensor detects the toner concentration change or fluctuation at the measurement area B along the timeline. The amount of toner per one supply operation, conducted by one driving operation of the Y drive source 71Y, may be referred to as "toner amount of per one supply." FIG. 6 shows example basic supply patterns H1, H2, H3, H4, and H5, different each other, which are toner supply profiles used for the toner supply operation, and each of the basic supply patterns H1, H2, H3, H4, and H5 may be also referred to as "basic supply profile." The toner supply amount per one toner supply operation increases in the order of the basic supply profiles H1, H2, H3, H4, and H5 (H1<H2<H3<H4<H5). The toner supply amount per one toner supply operation can be changed by changing the driving time duration and driving speed of the Y drive source 71Y per one toner supply operation.

Figure 7:
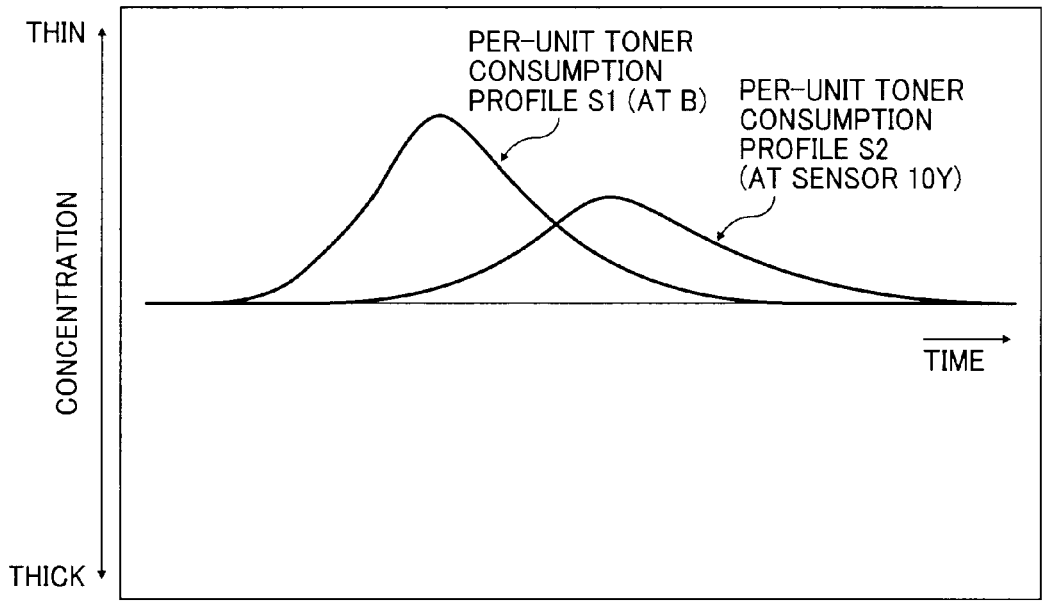
FIG. 7 shows a per-unit toner consumption profile detected near a toner supply port, and a per-unit toner consumption profile detected at a toner concentration detector disposed for a toner process cartridge.

Then, a per-unit toner consumption may be measured at a detection area of the measurement area B and a detection area of the toner concentration sensor 10Y. FIG. 7 shows a per-unit toner consumption profile measured at the measurement area B, and a per-unit toner consumption profile measured at a detection area of the toner concentration sensor 10Y. In this disclosure, the per-unit means one printing operation, and the one printing operation may be one sheet printing per one printing operation, ten-sheet printing per one printing operation, or the like.

The per-unit toner consumption profiles S1 and S2 shown in FIG. 7 can be measured as follows: First, a reference image (e.g., solid image) having a given image area is printed on the recording medium P as a per-unit image using the Y developing agent having no fluctuation of toner concentration, by which the Y toner is consumed for the amount of printing the per-unit image used for detecting toner concentration.

Then, without conducting a toner supply operation, a change or fluctuation of toner concentration along the timeline is detected by the measurement sensor and the toner concentration sensor 10Y. The per-unit toner consumption profile S1 is an example profile detected by the measurement sensor, and the per-unit toner consumption profile S2 is an example profile detected by the toner concentration sensor 10Y. The image area, used for detecting toner concentration for preparing such per-unit toner consumption profile may be referred to as "per-unit area," and the per-unit area is ideally a one-dot image area. However, there is a limit of "per-unit area" due to the resolution level limit and noise effect to a measurement sensor and a minimum toner supply capability of the toner supply device 70. Therefore, the "per-unit area" used for toner concentration detection is set as small as possible in view of such factors.

As shown in FIG. 7, the per-unit toner consumption profiles S1 and S2 have different shapes such as different width range and different peak height for concentration. Such difference may occur because the sensors are disposed at different positions. Specifically, because the Y developing agent having consumed the Y toner therein is transported in the development unit 7Y while being agitated by a toner transport member such as the first transport screw 8Y, the Y developing agent receives an agitation effect of screw and a diffusion effect. The agitation effect becomes different at each of the detection positions detected by each of the sensors because the transportation distances are different for different positions.

Figure 8:
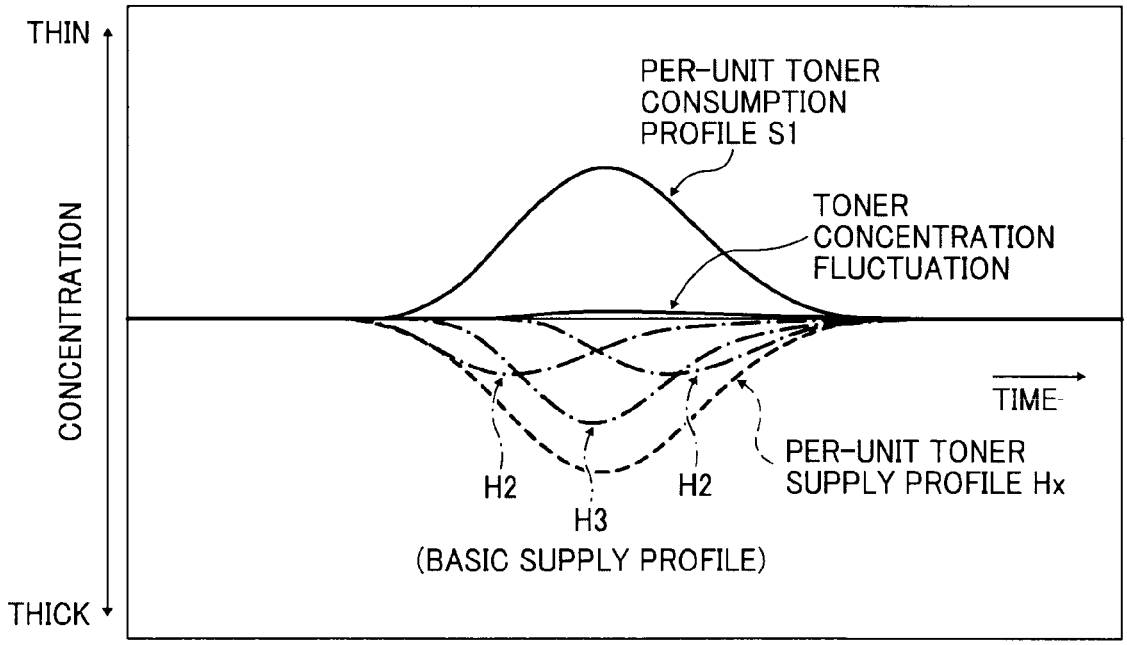
FIG. 8 shows a per-unit toner consumption profile, and a per-unit supply profile that can cancel out a toner concentration fluctuation shown as the per-unit toner consumption profile.

A description is given of a per-unit toner supply profile Hx that can cancel out the toner concentration fluctuation in the developing agent. The per-unit toner supply profile Hx, which can cancel out the toner concentration fluctuation caused by the per-unit toner consumption profile S1, is determined by using a given computing process. FIG. 8 shows the per-unit toner consumption profile S1, and the per-unit toner supply profile Hx that can cancel out the toner concentration fluctuation as shown as the per-unit toner consumption profile S1.

The per-unit toner consumption profile S1 detected at the measurement area B can be cancelled out by setting the per-unit toner supply profile Hx, which can be prepared by combing the basic supply profiles H1, H2, H3, H4, and H5 with a given combination. The per-unit toner consumption profile S1 indicates the toner concentration change at the measurement area B along the timeline when the Y developing agent passes the measurement area B after a latent image corresponding to a per-unit area, used for toner concentration detection, is developed by consuming toner.

Each of the basic supply profiles H1, H2, H3, H4, and H5 shows the toner concentration change at the measurement area B along the timeline for the Y developing agent when toner is supplied to the Y developing agent, wherein each of the basic supply profiles H1, H2, H3, H4, and H5 can be generated by changing the tone supply amount per one tone supply operation.

As shown in FIG. 8, the per-unit toner supply profile Hx can be prepared by combing the basic supply profiles H1, H2, H3, H4, and H5 with a given combination pattern, in which the per-unit toner supply profile Hx is prepared as a profile, which is substantially close to an opposite phase profile with respect to the per-unit toner consumption profile S1. By using such per-unit toner supply profile Hx for the toner supply operation, the fluctuation of toner concentration in the Y developing agent after passing the measurement area B can be reduced, in particular can be eliminated.

In such configuration, before the Y developing agent, which has developed the latent image corresponding to the per-unit area is transported to the second compartment 14Y and used for another development process again, the toner concentration fluctuation in the Y developing agent can be reduced, in particular eliminated.

When the per-unit toner supply profile Hx is determined as such, the toner supply operation can be conducted by using a given combination pattern of the basic supply profiles H1, H2, H3, H4, and H5 used for preparing the per-unit toner supply profile Hx, in which each of basic supply profiles H1, H2, H3, H4, and H5 can be used as the per-unit supply pattern.

In a case shown in FIG. 8, a toner supply operation corresponding to the second basic supply profile H2 is conducted at first, then a toner supply operation corresponding to the third basic supply profile H3 is conducted, and finally, a toner supply operation corresponding to the second basic supply profile H2 is conducted, by which the per-unit toner supply profile Hx can be set by composing such three basic supply profiles as one profile, and the per-unit toner supply profile Hx can become a profile which is substantially close to an opposite phase profile with respect to the per-unit toner consumption profile S1. As such, the per-unit toner supply profile Hx can be set as a per-unit supply pattern for the toner supply operation as shown in FIG. 8.

Figure 9:
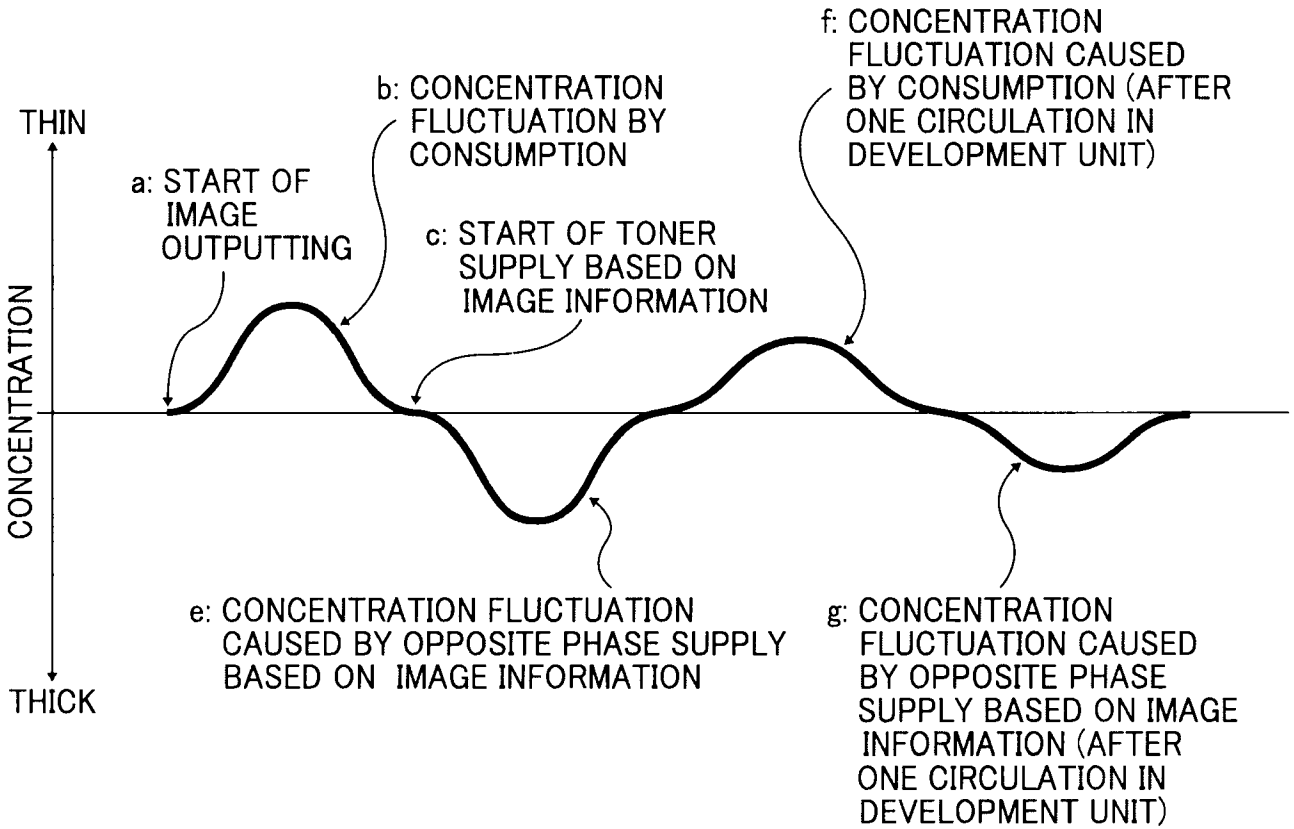
FIG. 9 shows a toner concentration fluctuation scheme when a toner supply operation based on image information cannot be conducted right after the toner consumption occurs, in which a toner supply timing and a toner consumption profile are shown.
Figure 10:
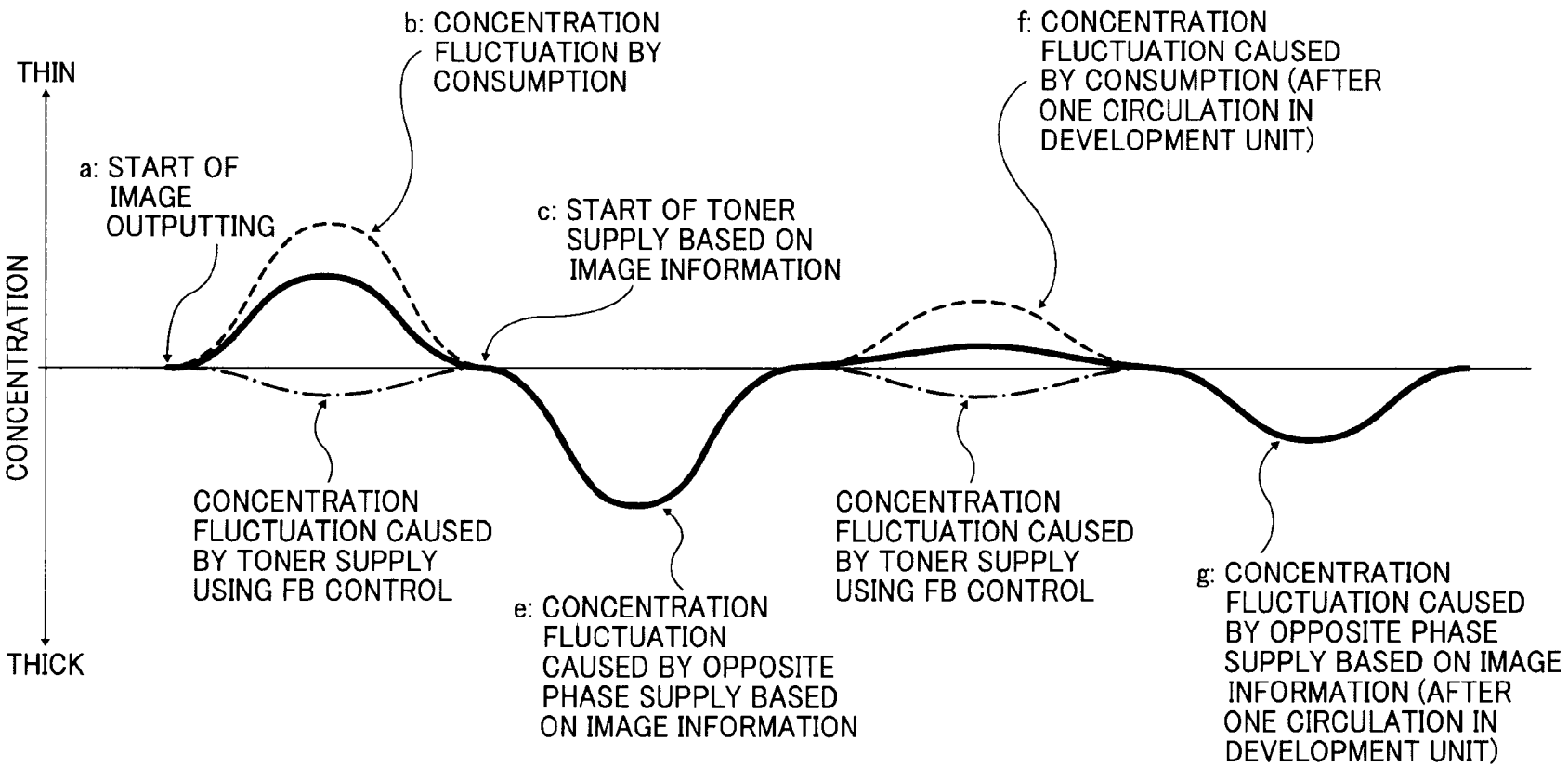
FIG. 10 shows a toner concentration fluctuation scheme when a toner supply operation based on image information cannot be conducted right after the toner consumption occurs, but a toner supply operation using a feedback (FB) control is applied right after the toner consumption occurs, in which a toner supply timing and a toner consumption timing are shown.

A description is given of a problem of toner supply control used for the conventional arts with reference to FIGS. 9 and 10. FIG. 9 shows a case that a toner supply operation based on image information cannot be conducted right after the toner consumption occurs, in which the toner consumption timing and the toner supply operation timing are shown with a toner concentration fluctuation profile. The toner consumption occurs when an image forming operation is conducted.

In a case of FIG. 9, a development process is started and toner consumption starts at an image-outputting start position indicated by "a." Then, the toner concentration becomes thin by consuming toner and the toner concentration fluctuates at the thin side (see "b" in FIG. 9). Then, after the image outputting is started and a given time elapses, a toner supply amount that can cancel out the predicted toner consumption amount is computed based on image information, which can be used to output an image, and the toner supply operation based on the image information is started at "c." The toner consumption amount can be predicted based on the image information.

Basically, after the optical writing unit writes the output image completely, the computation of toner supply amount is conducted and then a toner supply operation is started. Therefore, the toner supply operation may typically delay from a start timing of the toner consumption. FIG. 9 shows a case that the toner supply operation based on the image information can be conducted only after completing the toner consumption, in which the toner consumption causes the toner concentration fluctuation in the developing agent. Because the toner supply operation based on the image information is started after completing the toner consumption (see "c" in FIG. 9), the toner concentration fluctuation by the opposite-phase toner supply operation, determined from the image information, may occur at "e" as shown in FIG. 9.

Then, the toner concentration fluctuation caused by the toner consumption (see "b" in FIG. 9) becomes a condition at "f" in FIG. 9 after one circulation of the developing agent in the development unit 7Y, and the toner concentration fluctuation caused by the opposite phase toner supply operation (see "e" in FIG. 9) becomes a condition at "g" in FIG. 9 after one circulation of the developing agent in the development unit 7Y. Such toner concentration fluctuation may continue repeatedly. As shown by a bold line in FIG. 9, although the total fluctuation of toner concentration can be gradually attenuated by the diffusion of developing agent, the swinging phenomenon of toner concentration fluctuation occurs repeatedly, and the toner concentration fluctuation continues for some time.

In view of such conditions shown FIG. 9, a feedback (FB) control is applied as shown in FIG. 10. FIG. 10 shows a toner concentration fluctuation when the FB control using a toner concentration sensor or detector is applied, in which the toner supply timing and the toner consumption timing are shown.

FIG. 10 shows a case that a toner supply operation based on image information cannot be conducted right after the toner consumption occurs, but a toner supply operation using the FB control can be conducted right after the toner consumption occurs, in which the toner consumption timing and toner supply operation timing are shown with a toner concentration fluctuation profile.

In a case of FIG. 10, a development process is started and toner consumption starts at an image-outputting start position indicated by "a." By detecting that the toner concentration fluctuation is at the thin side using a toner concentration sensor, a toner supply operation using the FB control can be gradually conducted right after the toner consumption occurs (see area under "b" in FIG. 10). Then, after the image outputting is started and a given time elapses, a toner supply amount that can cancel out the to-be-predicted toner consumption amount is computed based on image information, which can be used to output an image, and the toner supply operation based on the image information is started at "c." The toner consumption amount can be predicted based on the image information.

Basically, after the optical writing unit writes the output image completely, the computation of toner supply amount is conducted and then a toner supply operation is started. Therefore, the toner supply operation may typically delay from a start timing of the toner consumption. FIG. 10 shows a case that the toner supply operation based on the image information can be conducted only after completing the toner consumption, in which the toner consumption causes the toner concentration fluctuation. Because the toner supply operation based on the image information is started after completing the toner consumption (see "c" in FIG. 10), the toner concentration fluctuation by the opposite-phase toner supply operation, determined from the image information, may occur at "e" as shown in FIG. 10.

When compared to a case shown in FIG. 9, the total fluctuation of toner concentration at the toner consumption timing (see "b" in FIG. 10) can be reduced by employing the FB control for the toner supply operation as shown by a bold line in FIG. 10.

In a case shown in FIG. 10, the opposite-phase toner supply operation, determined from the image information, is also conducted to cancel out the consumed toner amount, which is consumed at the toner consumption timing. Therefore, at the time of completing the opposite-phase toner supply operation, which can be determined from the image information, the toner amount supplied to the developing agent may be excessively supplied with an amount corresponding to the toner amount supplied using the FB control. As for the toner supply control system, the toner supply amount can be controlled but the toner consumption cannot be controlled, by which the excessive toner supply condition may occur temporarily. Therefore, depending on the use environment of users, such excessive toner supply condition may occur and continue, in which the image outputting with high quality cannot be conducted.

In such a configuration, the toner concentration fluctuation in the developing agent, caused by the toner consumption, may remain along the timeline.

When the developing agent circulates the development unit 7 for one circulation, the toner concentration sensor 10 detects such remaining toner concentration fluctuation (see "f" in FIG. 10), and the toner supply operation using the FB control is conducted, by which the toner concentration fluctuation can be reduced gradually (see "f" in FIG. 10). However, the toner concentration fluctuation caused by the opposite-phase toner supply operation, determined based on the image information, still remains even if the developing agent circulates the development unit 7 for one circulation (see "g" in FIG. 10).

When compared to a case shown in FIG. 9, the fluctuation of toner concentration at the toner consumption timing can be reduced by applying the toner supply operation using the FB control (see "b" in FIG. 10), and the fluctuation of toner concentration after circulating the developing agent for one circulation in the development unit 7 can be reduced by applying the toner supply operation using the FB control (see "f" in FIG. 10). As shown by a bold line in FIG. 10, although the total fluctuation of toner concentration can be gradually attenuated by the diffusion of developing agent, the swinging phenomenon of toner concentration fluctuation occurs repeatedly, and the toner concentration fluctuation continues for some time.

In view of the above described issue for the toner supply operation, a description is given of a toner supply control system or method according to example embodiments, in which a toner supply amount and timing can be determined preferably. Specifically, the toner supply amount is computed using a toner supply amount determined from the image information, and a toner supply amount determined from the toner concentration sensor 10, and a target toner concentration can be set with high precision.

A toner supply control system according to a first example embodiment uses the toner concentration sensor 10 (10Y to 10K) and the control unit 100.

The toner concentration sensor 10, disposed at the downstream side of transporting direction of the developing agent with respect to a toner supplying area or position of the toner supply device 70, detects the toner concentration of two-component developing agent continuously or discontinuously.

The control unit 100 includes the prediction data computing unit 101, which may include functions of an image-information-based consumption prediction unit, a toner-concentration-based consumption prediction unit, and a toner supply determination unit.

The image-information-based consumption prediction unit predicts a toner consumption amount based on the image information, which can be obtained from the optical writing device 20 that writes an image based on the image information.

The toner-concentration-based consumption prediction unit predicts a toner amount, consumed in the developing unit, based on a detection result such as a detection signal of the toner concentration sensor 10.

The toner supply determination unit can compute a timing when the developing agent, having consumed toner at the toner consumption timing, comes to the toner supply area or position of the toner supply device 70 at a second time after consuming toner for forming an image. Right after the toner consumption occurs, the developing agent having consumed toner comes to the toner supply area or position of the toner supply device 70 (i.e., first time). However, due to constrain of toner supply control, a toner supply operation may not be conducted when the developing agent having consumed toner comes to the toner supply area or position of the toner supply device 70 for the first time after the toner consumption occurs. The toner supply determination unit computes a toner supply amount from the toner consumption amount which is determined by the image-information-based consumption prediction unit, and the toner consumption amount determined by the toner-concentration-based consumption prediction unit.

The supply control unit 102 computes and adjusts the toner supply amount determined by the toner supply determination unit as a toner supply amount to be required for the toner supply operation.

Specifically, the supply control unit 102 computes the toner supply amount required for the toner supply operation, expressed as image information by combing two types of toner supply amount data, wherein one type of toner supply amount data is computed from the image information itself by using the image-information-based consumption prediction unit, and another one type of toner supply amount data is determined by using the toner-concentration-based consumption prediction unit and expressed as image information.

Further, the supply control unit 102 converts the toner consumption amount determined by the toner-concentration-based consumption prediction unit to the toner supply amount which is incorporated with a timing information of toner supply operation.

Such toner consumption amount is incorporated to a value computed by the image-information-based consumption prediction unit, in which the computed value may be used as it is, or the computed value is applied with a gain value, which is changeable, and then the toner supply amount for the toner supply operation is computed.

The toner supply control system according to the first example embodiment can be effectively used for a toner supply control system and method using image information even if a toner supply operation cannot be conducted right after the toner consumption occurs.

For example, the toner concentration fluctuation in the development unit 7 can be cancelled out by conducting an opposite-phase toner supply operation, wherein the opposite-phase toner supply operation may be conducted in view of the toner supply amount, determined from the toner consumption corresponding to output image information, the toner supply amount determined by the toner concentration sensor 10 and the FB control, and agitation and diffusion effect of toner after circulating the developing agent in the development unit 7 for a given distance. With such a configuration, the target toner concentration can be set with a high precision, and thereby images can be produced with high quality.

Further, the toner supply amount determined by the toner concentration sensor can be converted to image information such as image area information, by which the overall toner supply amount can be computed based on the image area information, which is one of image information, by which the target toner concentration can be set with a high precision, and thereby images can be produced with high quality.

Further, the toner supply amount determined by the toner concentration sensor can be modified by applying a gain value, and then the gain-applied value can be incorporated to the toner supply amount computed based on the image information, by which the overall toner supply amount can be computed based on the image information such as image area information, by which the target toner concentration can be set with a high precision, and thereby images can be produced with high quality.

Further, a toner supply control system according to a second example embodiment uses the toner concentration sensor 10 (10Y to 10K) and the control unit 100.

The toner concentration sensor 10, disposed at the downstream side of transporting direction of the developing agent with respect to a toner supplying area or position of the toner supply device 70, detects the toner concentration of two-component developing agent continuously or discontinuously.

The control unit 100 includes the prediction data computing unit 101, which may include functions of an image-information-based consumption prediction unit, a toner-concentration-based consumption prediction unit, and a toner supply determination unit.

The image-information-based consumption prediction unit predicts a toner consumption amount based on the image information, which can be obtained from the optical writing device 20 that writes an image based on the image information.

The toner-concentration-based consumption prediction unit predicts a toner amount, consumed in the developing unit, based on a detection result such as a detection signal of the toner concentration sensor 10.

The toner supply determination unit can compute a timing when the developing agent, having consumed toner at the toner consumption timing, comes to the toner supply area or position of the toner supply device 70 for the first time after consuming toner, and the second time after the first time. In view of such timing that the developing agent having consumed toner passes the toner supply area again, the toner supply determination unit computes a toner supply amount from the toner consumption amount determined by the image-information-based consumption prediction unit, and the toner consumption amount determined by the toner-concentration-based consumption prediction unit.

The supply control unit 102 computes and adjusts the toner supply amount determined by the toner supply determination unit as a toner supply amount to be required for the toner supply operation.

Specifically, the supply control unit 102 computes the toner supply amount required for the toner supply operation, expressed as image information, in which the image information may be composed of first segment information and second segment information, and the first segment information and second segment information may be used at different timing for toner supply operation. The first segment information is obtained at a timing that a toner supply operation using the first segment information cannot be conducted right after the toner consumption occurs. The second segment information is obtained at a timing that a toner supply operation using the second segment information can be conducted right after the toner consumption occurs.

As for the first segment information, which cannot be received or obtained in good enough time for conducting an toner supply operation right after the developing agent consumes toner by conducting an image forming operation, the supply control unit 102 computes a first toner supply amount corresponding to the first segment information.

As for the second segment information, which can be received or obtained in good enough time for conducting an toner supply operation right after the developing agent consumes toner by conducting an image forming operation, the supply control unit 102 computes a second toner supply amount corresponding to the second segment information, and then incorporates the toner supply amount information determined by the toner-concentration-based consumption prediction unit, and converts such information to data expressed by the image information such as image area information.

Further, as for the first segment information, which cannot be received or obtained in good enough time for conducting an toner supply operation right after the developing agent consumes toner by conducting an image forming operation, the supply control unit 102 computes the first toner supply amount corresponding to the first segment information by incorporating a timing information of toner supply operation, and the supply control unit 102 instructs a toner supply operation of the toner supply amount computed by using the first segment information when the developing agent comes to the toner supply area of the toner supply device again after the toner consumption occurs (i.e., second time).

Further, as for the second segment information, which can be received or obtained in good enough time for conducting an toner supply operation right after the developing agent consumes toner by conducting an image forming operation, the supply control unit 102 computes the second toner supply amount using the second segment information by incorporating the toner supply amount computed by using the detection result of the toner-concentration-based consumption prediction unit, and the supply control unit 102 instructs a toner supply operation using the second toner supply amount computed by using the second segment information with a toner supply operation of the toner supply amount computed using the detection result of the toner-concentration-based consumption prediction unit right after the toner consumption occurs.

In the toner supply control system according to the second example embodiment, the toner supply control method using the image information may be conducted as follows.

As for the second segment information, the toner supply amount corresponding to the second image information is computed and supplied by conducting a toner supply operation right after the toner consumption occurs.

As for the first segment information, the toner concentration fluctuation in the development unit 7 can be cancelled out by conducting an opposite-phase toner supply operation after circulating the developing agent in the development unit 7 for a given distance such as one circulation in the development unit 7. The opposite-phase toner supply operation may be conducted by setting a first toner supply amount, which can be determined from the toner consumption amount corresponding to the first segment image information by incorporating the toner supply amount determined by using the toner concentration sensor 10 and the FB control, and agitation and diffusion effect of toner after circulating the developing agent in the development unit 7 for a given distance. With such a configuration, the target toner concentration can be set with a high precision, and thereby images can be produced with high quality.

Further, as for the first segment information, the toner supply amount determined by the toner concentration sensor 10 and the FB control can be converted to image information such as image area information, and such converted value is incorporated to the first toner supply amount determined by the first segment information, by which the overall toner supply amount can be computed based on the image area, which is one of image information, by which the target toner concentration can be set with a high precision, and thereby images can be produced with high quality.

Further, as for the first segment information, the toner supply amount determined by the toner concentration sensor 10 and the FB control can be modified by applying a gain value, and then such gain-applied value can be incorporated to the first toner supply amount computed based on the first segment information, by which the overall toner supply amount can be computed based on the image information such as image area information, by which the target toner concentration can be set with a high precision, and thereby images can be produced with high quality.

First Example Embodiment

As for the toner supply control system of the first example embodiment, a toner supply operation to cancel out the toner concentration fluctuation at the thin side can be conducted as follows. Right after the toner consumption occurs, a toner supply operation based on image information is not conducted, but the toner concentration is detected and a feedback (FB) control based on the detection result of the toner concentration is conducted to supply a given amount of toner. Then, after circulating the developing agent in the development unit 7 for a given distance such as one circulation in the development unit 7, an opposite-phase toner supply operation, computed in view of the image formation and a toner supply amount already supplied by the FB control, can be matched to the toner consumption area having the thin toner concentration fluctuation, by which the toner concentration fluctuation at the thin side can be cancelled out effectively.

Figure 11:
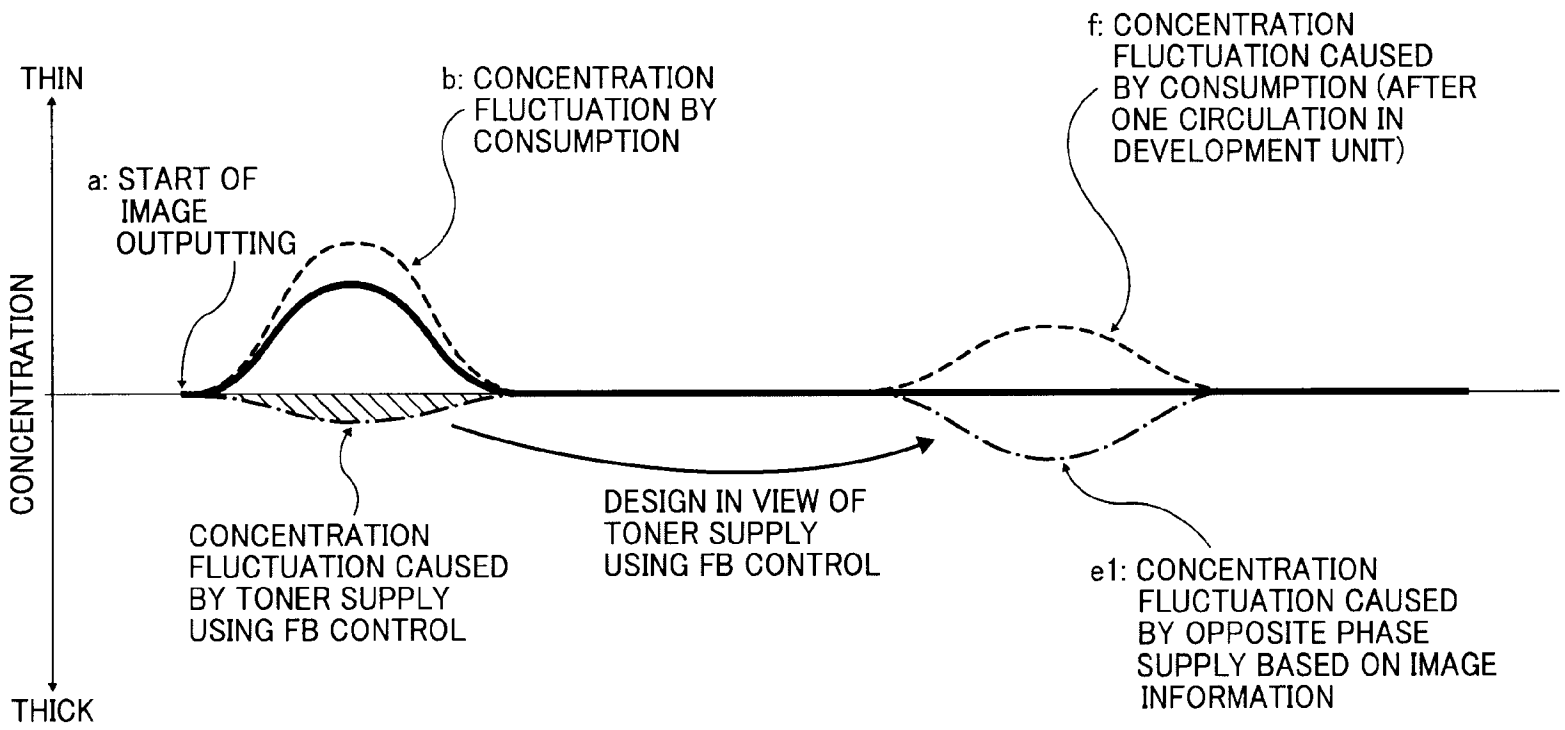
FIG. 11 shows a toner concentration fluctuation scheme according to an example embodiment, in which a toner consumption profile after circulating in a development unit for one circulation can be cancelled out by conducting an opposite-phase toner supply operation in view of a toner supply amount determined by a feedback (FB) control, in which a toner supply timing and a toner consumption timing are shown.

A description is given of the toner supply amount and timing for the first example embodiment with reference to FIG. 11. FIG. 11 shows a case that the toner consumption profile, having the toner concentration fluctuation at the thin side, can be cancelled out by conducting an opposite-phase toner supply operation in view of the toner supply amount supplied by the FB control after circulating the developing agent in the development unit 7 for a given distance such as one circulation in the development unit 7.

In FIG. 11, a development process is started and a toner consumption starts from an image outputting start position indicated by "a." Then, the toner concentration becomes thin by the toner consumption (see "b" in FIG. 11), in which depending on a detection level by the toner concentration sensor 10, the FB control is activated to conduct a toner supply operation (see hatched area in FIG. 11). Although the toner supply operation based on the image information can be conducted after "b," the toner supply operation based on the image information is not conducted at this timing as shown in FIG. 11. Therefore, different from the conventional cases shown in FIGS. 9 and 10, the toner concentration fluctuation at the thick side may not occur after "b" as shown in FIG. 11.

After circulating the developing agent for a given distance such as one circulation in the development unit 7, the toner concentration fluctuation at the thin side, caused by the toner consumption, also circulates the development unit 7 for one circulation, at which the opposite-phase toner supply operation is conducted to cancel out the toner concentration fluctuation at the thin side. Because the developing agent circulates for one circulation with a given time duration after the toner consumption occurs at "b" (see FIG. 11), which may be enough for computing a toner supply amount and timing for the opposite-phase toner supply operation, it becomes easy to match the opposite phase toner supply operation with the toner concentration fluctuation at the thin side (see "f" and "e1" in FIG. 11).

Further, when preparing the opposite-phase toner supply operation, the toner supply amount already supplied by the FB control is considered, by which the toner amount in the development unit 7 may not become an excessive toner condition, and thereby the toner supply operation to cancel out the thin toner condition can be conducted at a preferable timing with a preferable amount. Therefore, although the toner concentration fluctuation occurs at "b" as shown in FIG. 11, the toner concentration fluctuation at the thin side (see "f" in FIG. 11) and the toner concentration fluctuation at the thick side (see "e1" in FIG. 11) can cancel each other, by which the developing agent without toner concentration fluctuation can be set.

Figure 12:
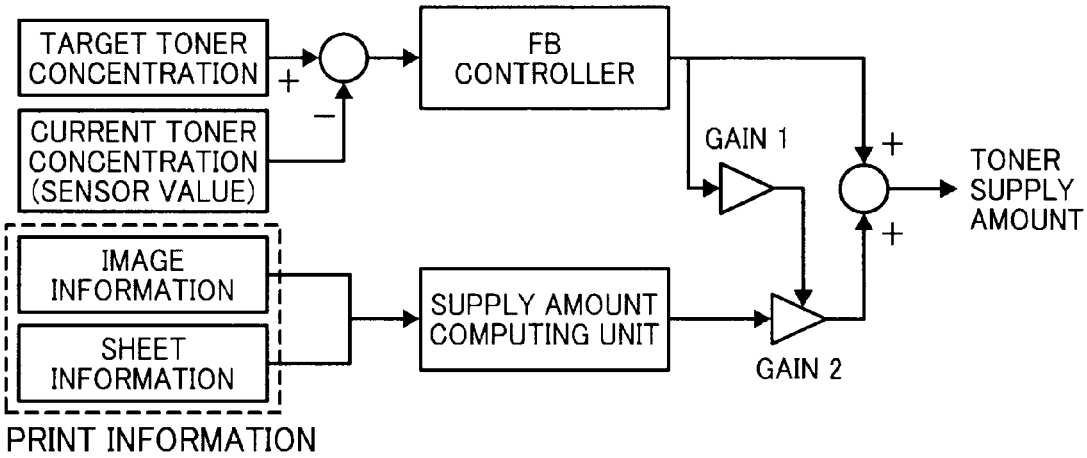
FIG. 12 shows an example block diagram of a toner supply control system for setting a toner supply amount and timing according to an example embodiment.
Figure 13:
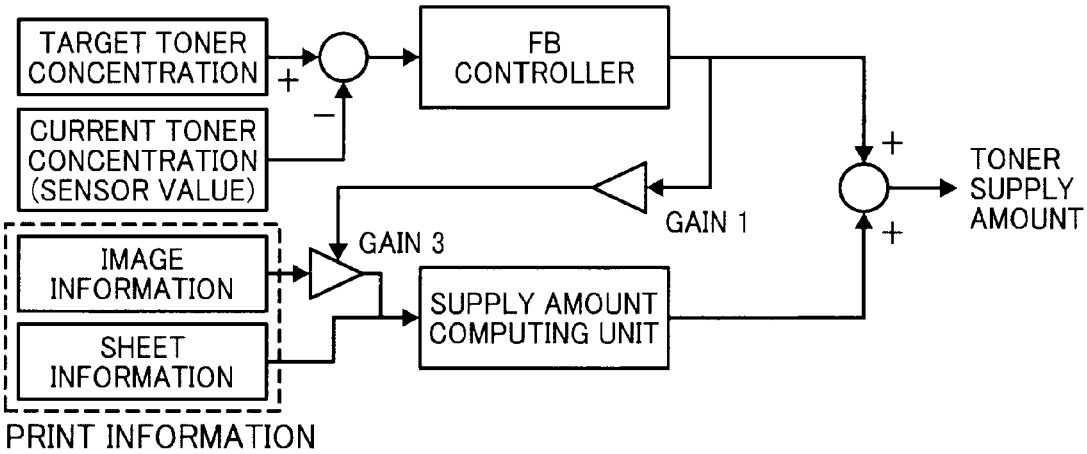
FIG. 13 shows another example block diagram of a toner supply control system for setting a toner supply amount and timing according to an example embodiment.
Figure 14:
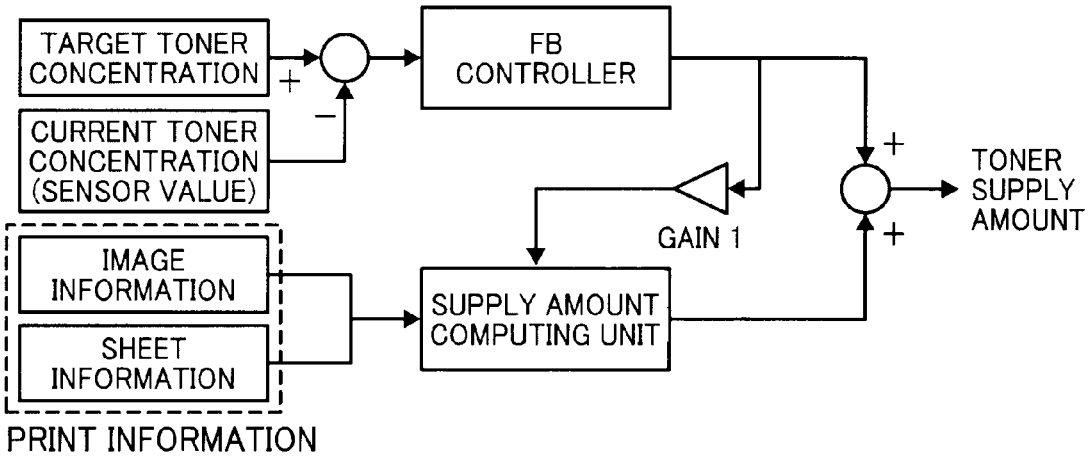
FIG. 14 shows another example block diagram of a toner supply control system for setting a toner supply amount and timing according to an example embodiment.

FIGS. 12 to 14 show example block diagrams of the toner supply control system for controlling the toner supply amount and timing according to example embodiments.

FIG. 12 shows a block diagram of the toner supply control system, in which an opposite-phase toner supply operation prepared from the image information is incorporated with the toner supply amount determined by the FB control while applying a gain adjustment.

A target value of toner concentration and a current value of toner concentration, which is detected by the toner concentration sensor 10, are compared each other, and input to a feedback (FB) controller. The FB controller computes a required toner supply amount based on the comparison of such values.

Further, information related to the to-be-output image such as image information and sheet information is input to a supply amount computing unit. The image information and sheet information may be collectively referred to as "print information." The supply amount computing unit computes a toner supply amount and timing of the opposite-phase toner supply operation based on a toner consumption amount and timing, which can be obtained from the image information, by which the opposite phase toner supply operation to cancel out the toner concentration fluctuation can be computed.

Specifically, the supply amount computing unit does not output a signal of opposite-phase toner supply operation right after the toner concentration fluctuation due to the toner consumption (see a section after "b" in FIG. 11). Instead, the supply amount computing unit outputs a signal of opposite-phase toner supply operation after circulating the developing agent in the development unit 7 for at least one circulation while incorporating a diffusion effect of toner in the development unit 7. In such a configuration, the toner supply amount value computed by the FB controller and the toner supply amount value computed by the supply amount computing unit are totaled to compute an overall toner supply amount used for the opposite-phase toner supply operation.

The toner supply amount value output from the FB controller is set to a value by applying a gain value at gain 1, and such gain-applied value can be used to change a parameter of gain 2 that can adjust the toner supply amount output from the supply amount computing unit. In such a configuration, the toner supply amount value computed by the supply amount computing unit can be adjusted by using the toner supply amount value computed by the FB control. For example, the toner supply amount value computed by the supply amount computing unit can be reduced by using a value of the gain 2. As shown in FIG. 11, the toner concentration fluctuation can be reduced by supplying toner in view of the toner amount supplied by the FB control, in which the excessive toner supply condition may not occur.

FIG. 13 shows a block diagram of the toner supply control system, in which the opposite-phase toner supply operation prepared from the image information is incorporated with the toner supply amount determined by the FB control by applying a gain adjustment. The portion same as FIG. 12 is not explained.

The toner supply amount value computed by the FB controller and the toner supply amount value computed by the supply amount computing unit are totaled to compute an overall toner supply amount. The toner supply amount value output from the FB controller is set to a value by applying a gain value at gain 1, and then the parameter of gain 3 is changed by the value output from the gain 1. The parameter of gain 3 can be used to adjust the image information such image area. In such a configuration, the toner supply amount value computed by the supply amount computing unit can be adjusted by using the toner supply amount value computed by the FB control. For example, the toner supply amount value computed by the supply amount computing unit can be reduced by using a value of the gain 3. As shown in FIG. 11, the toner concentration fluctuation can be reduced by supplying toner in view of the toner amount supplied by the FB control, in which the excessive toner supply condition may not occur.

FIG. 14 shows a block diagram of the toner supply control system in which the opposite-phase toner supply operation prepared from the image information is incorporated with the toner supply amount determined by the FB control by applying a gain adjustment. The portion same as FIG. 12 is not explained.

The toner supply amount value computed by the FB controller and the toner supply amount value computed by the supply amount computing unit are totaled to compute an overall toner supply amount.

The toner supply amount value output from the FB controller is set to a value by applying a gain value at gain 1, and such gain-applied value is input to the supply amount computing unit. The supply amount computing unit computes the toner supply amount and supply timing based on the image information, and changes the toner supply amount and supply timing in view of the gain-applied value, input from the FB controller. For example, composition parameters and composition parameter tables, prepared in advance, can be changed or switched in view of the toner supply amount value input from by the FB control. As shown in FIG. 11, the toner concentration fluctuation can be reduced by supplying toner in view of the toner amount supplied by the FB control, in which the excessive toner supply condition may not occur.

Further, the correction value output from the FB control can be applied to other portions not shown in FIGS. 12 to 14. Further, the gain can be set other portions not shown in FIGS. 12 to 14. Further, the systems shown in FIGS. 12 to 14 can be combined.

The first example embodiment uses such toner supply control system or method, in which the target toner concentration can be set with a high precision, and thereby images can be produced with high quality.

Figure 15:
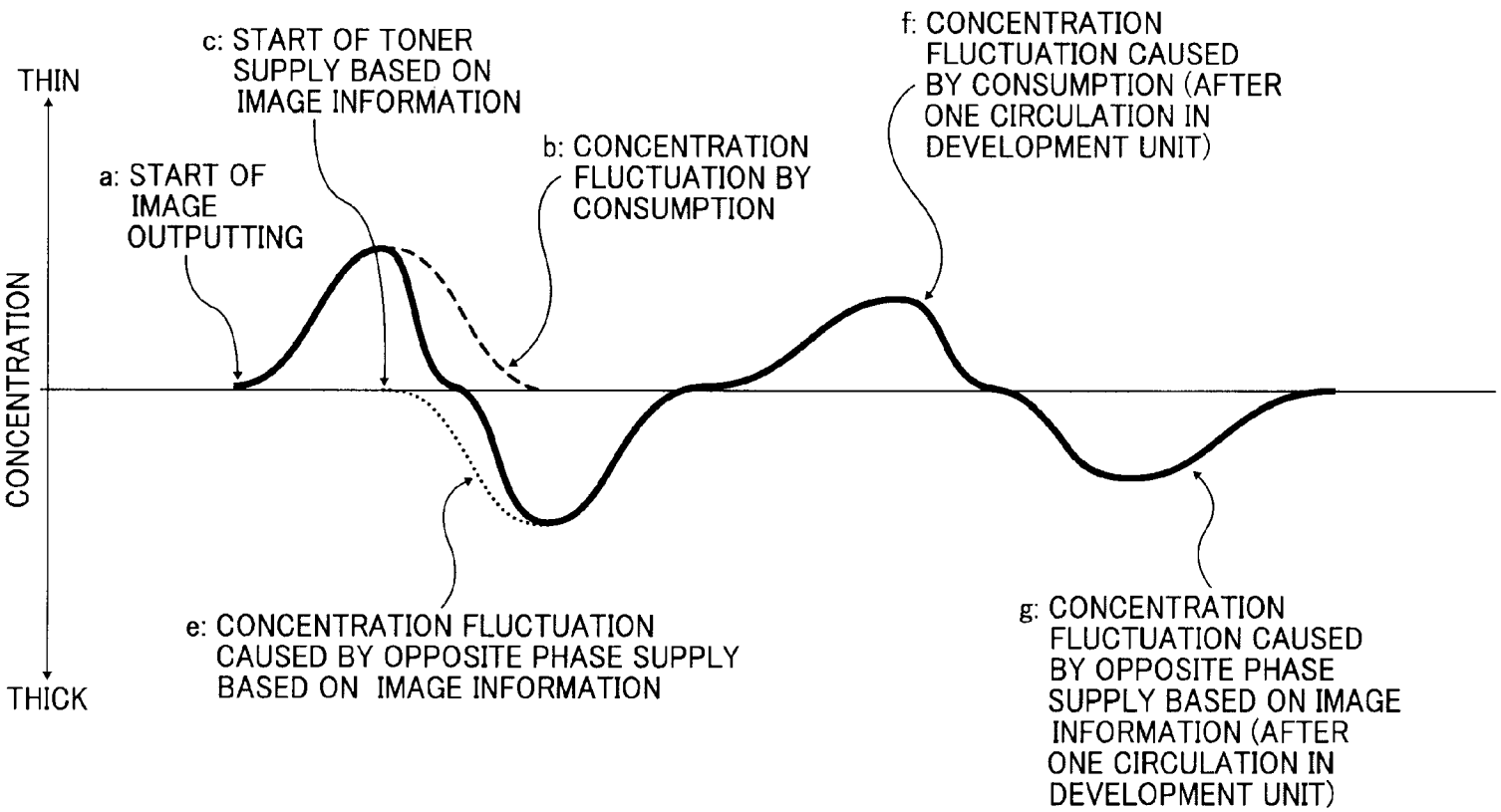
FIG. 15 shows a toner concentration fluctuation scheme, in which a toner supply operation based on image information can be started right after the toner consumption occurs, but a toner supply operation based on the image information cannot be completely conducted, in which a toner supply timing and a toner consumption timing are shown.
Figure 16:
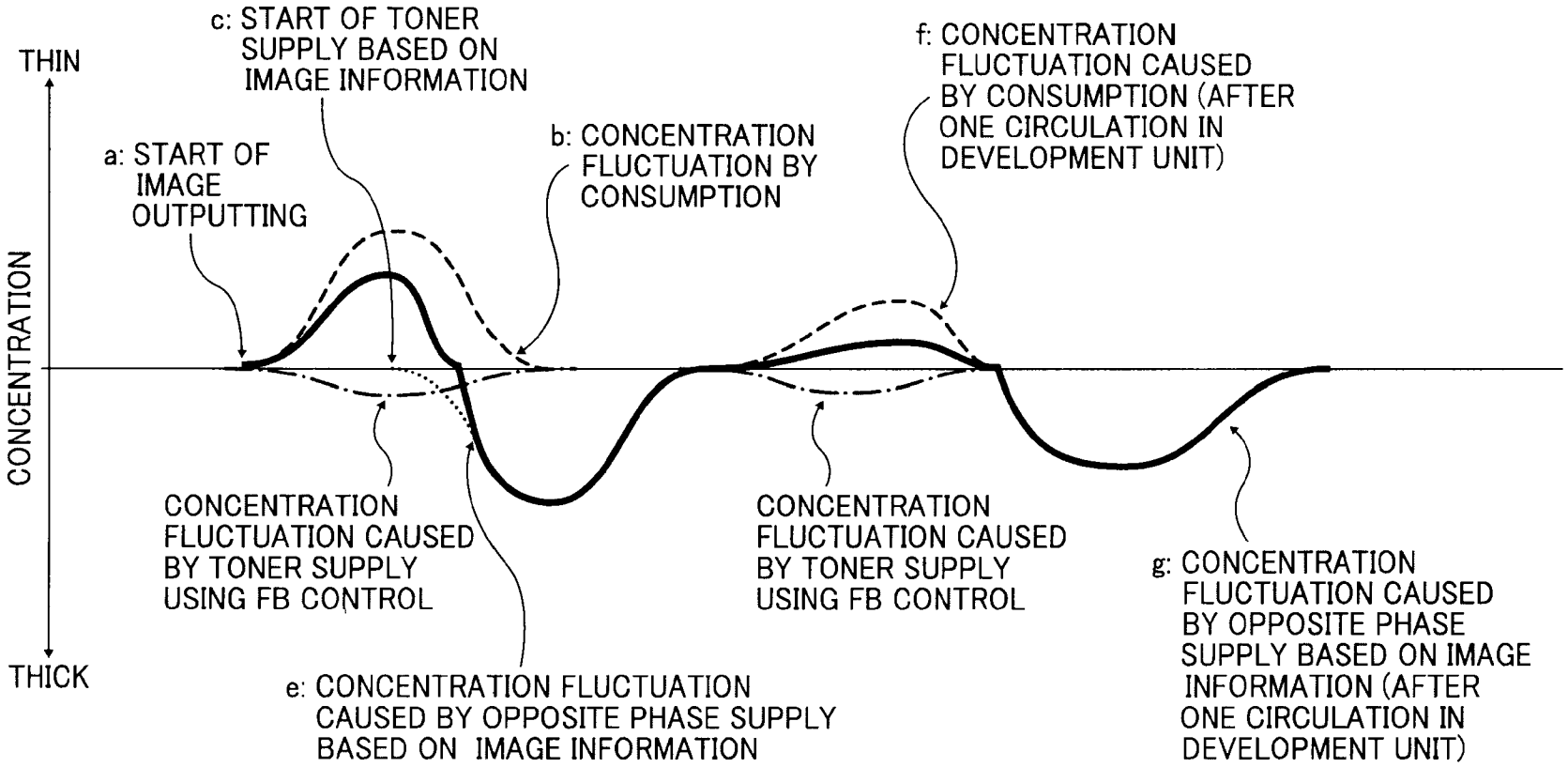
FIG. 16 shows a toner concentration fluctuation scheme, in which a toner supply operation based on image information can be started right after the toner consumption occurs, but a toner supply operation based on the image information cannot be completely conducted right after the toner consumption occurs, but a toner supply by a feedback (FB) control is applied right after the toner consumption occurs, in which a toner supply timing and a toner consumption timing are shown.

A description is given of another conventional case that the toner supply operation can be started right after the toner consumption occurs with reference to FIGS. 15 and 16.

In a case of FIG. 15, the toner supply operation based on image information can be started right after the toner consumption occurs, and the timing of toner supply operation based on the image information can be partially matched to the toner consumption profile (i.e., the timing of toner supply operation based on the image information cannot be completely matched to the toner consumption profile).

In FIG. 15, a development process is started and toner consumption starts at an image-outputting start position indicated by "a." Then, the toner concentration becomes thin by consuming toner and the toner concentration fluctuates at the thin side (see "b" in FIG. 15). Then, after the image outputting is started and a given time elapses, a toner supply amount that can cancel out the to-be-predicted toner consumption amount is computed using the image information, and the toner supply operation based on the image information is started at "c," which is the middle of the toner consumption profile. The toner consumption amount can be predicted based on the image information.

Basically, after the optical writing unit writes the output image completely, the computation of toner supply amount is conducted and then a toner supply operation is started. Therefore, the toner supply operation may typically delay from a start timing of the toner consumption. FIG. 15 shows a case that the toner supply operation using the image information can be started right after the toner consumption occurs, in which the toner consumption causes the toner concentration fluctuation. Because the toner supply operation based on the image information is started after the toner consumption occurs (see "c" in FIG. 15), the toner concentration fluctuation due to the opposite-phase toner supply operation based on the image information may occur (see "e" in FIG. 15) after the toner consumption is completed.

Then, the toner concentration fluctuation, caused by the toner consumption (see "b" in FIG. 15), circulates the development unit 7 for one circulation (see "f" in FIG. 15), and the toner concentration fluctuation caused by the opposite-phase toner supply operation also circulates the development unit 7 for one circulation (see "g" in FIG. 15), and such conditions may continue repeatedly. As shown by a bold line in FIG. 15, although the total fluctuation of toner concentration can be gradually attenuated by the diffusion of developing agent, the swinging phenomenon of toner concentration fluctuation occurs repeatedly, and the toner concentration fluctuation continues for some time.

In view of such conditions shown FIG. 15, a feedback (FB) control is applied as shown in FIG. 16. FIG. 16 shows the toner concentration fluctuation when the FB control using the toner concentration sensor is employed, and the toner supply timing and the toner consumption timing are shown.

FIG. 16 shows a case that a toner supply operation based on image information can be started right after the toner consumption occurs with a toner supply operation using the FB control, but the toner supply operation based on the image information cannot be completely matched to the toner consumption profile.

In FIG. 16, a development process is started and toner consumption starts at an image-outputting start position indicated by "a." By detecting that the toner concentration fluctuation at the thin side using the toner concentration sensor 10, a toner supply operation using the FB control can be gradually conducted as shown in FIG. 16. Then, after the image outputting is started and a given time elapses, a toner supply amount that can cancel out the predicted toner consumption amount is computed based on image information, which can be used to output an image, and the toner supply operation based on the image information is started at "c." The toner consumption amount can be predicted based on the image information.

Basically, after the optical writing unit writes the output image completely, the computation of toner supply amount is conducted and then a toner supply operation is started. Therefore, the toner supply operation may typically delay from a start timing of the toner consumption. FIG. 16 shows a case that the toner supply operation based on the image information can be started right after the toner consumption occurs, in which the toner consumption causes the toner concentration fluctuation. Because the toner supply operation based on the image information can be started right after the toner consumption occurs (see "c" in FIG. 16), the toner concentration fluctuation due to the opposite-phase toner supply operation based on the image information may occur (see "e" in FIG. 16) after the toner consumption is completed.

When compared to a case shown in FIG. 15, the fluctuation of toner concentration of toner consumption profile (see "b" in FIG. 16) can be reduced by employing the FB control for the toner supply operation as shown by a bold line in FIG. 16.

In a case shown in FIG. 16, the opposite-phase toner supply operation, determined based on the image information, is also conducted to cancel out the toner amount consumed at the toner consumption timing. Therefore, at the time of completing the opposite-phase toner supply operation, the toner amount supplied to the developing agent may be excessively supplied with an amount corresponding to the toner amount supplied by the FB control. As for the toner supply control system, the toner supply amount can be controlled but the toner consumption cannot be controlled, by which the excessive toner supply condition may occur temporarily. Therefore, depending on the use environment of users, such excessive toner supply condition may occur and continue, in which the image outputting with high quality cannot be conducted.

In such a configuration, the toner concentration fluctuation in the developing agent, caused by the toner consumption, may remain along the timeline.

When the developing agent circulates the development unit 7 for one circulation, the toner concentration sensor 10 detects such remaining toner concentration fluctuation (see "f" in FIG. 16), and the toner supply operation using the FB control is conducted, by which the toner concentration fluctuation can be reduced gradually (see "f" in FIG. 16). However, the toner concentration fluctuation caused by the opposite-phase toner supply operation, determined based on the image information, still remains even if the developing agent circulates the development unit 7 for one circulation (see "g" in FIG. 16).

When compared to a case shown in FIG. 15, the fluctuation of toner concentration at the toner consumption timing can be reduced by applying the toner supply operation using the FB control for the toner supply operation (see "b" in FIG. 16), and the total fluctuation of toner concentration after circulating the developing agent for one circulation in the development unit 7 can be reduced by applying the FB control for the toner supply operation (see "f" in FIG. 16). As shown by a bold line in FIG. 16, although the total fluctuation of toner concentration can be gradually attenuated by the diffusion of developing agent, the swinging phenomenon of toner concentration fluctuation occurs repeatedly, and the toner concentration fluctuation continues for some time.

Second Example Embodiment

As for the toner supply control system of the second example embodiment, a toner supply operation to cancel out the toner concentration fluctuation at the thin side can be conducted as follows. Right after the toner consumption occurs, a toner supply operation based on image information is conducted partially, which means that the toner supply operation based on image information cannot be completely conducted right after the toner consumption occurs, but a toner supply operation using a feedback (FB) control can be conducted by detecting the toner concentration at the toner consumption timing while the toner supply operation based on image information can be partially conducted.

Specifically, as for the toner supply operation based on the image information that can be conducted right after the toner consumption occurs, the toner supply operation is conducted by supplying a given amount of toner corresponding to the image information which can be handled right after the toner consumption occurs.

As for the toner supply operation based on the image information that cannot be conducted right after the toner consumption occurs, the toner supply operation using such information can be matched to the toner consumption area caused by the toner consumption after circulating the developing agent in the development unit 7 for a given distance such as one circulation in the development unit 7. In such a configuration, an opposite-phase toner supply operation, computed in view of the image formation and the toner supply amount already supplied by the FB control, can be matched to the toner consumption area in the developing agent, by which the toner concentration fluctuation can be cancelled out effectively.

Figure 17:
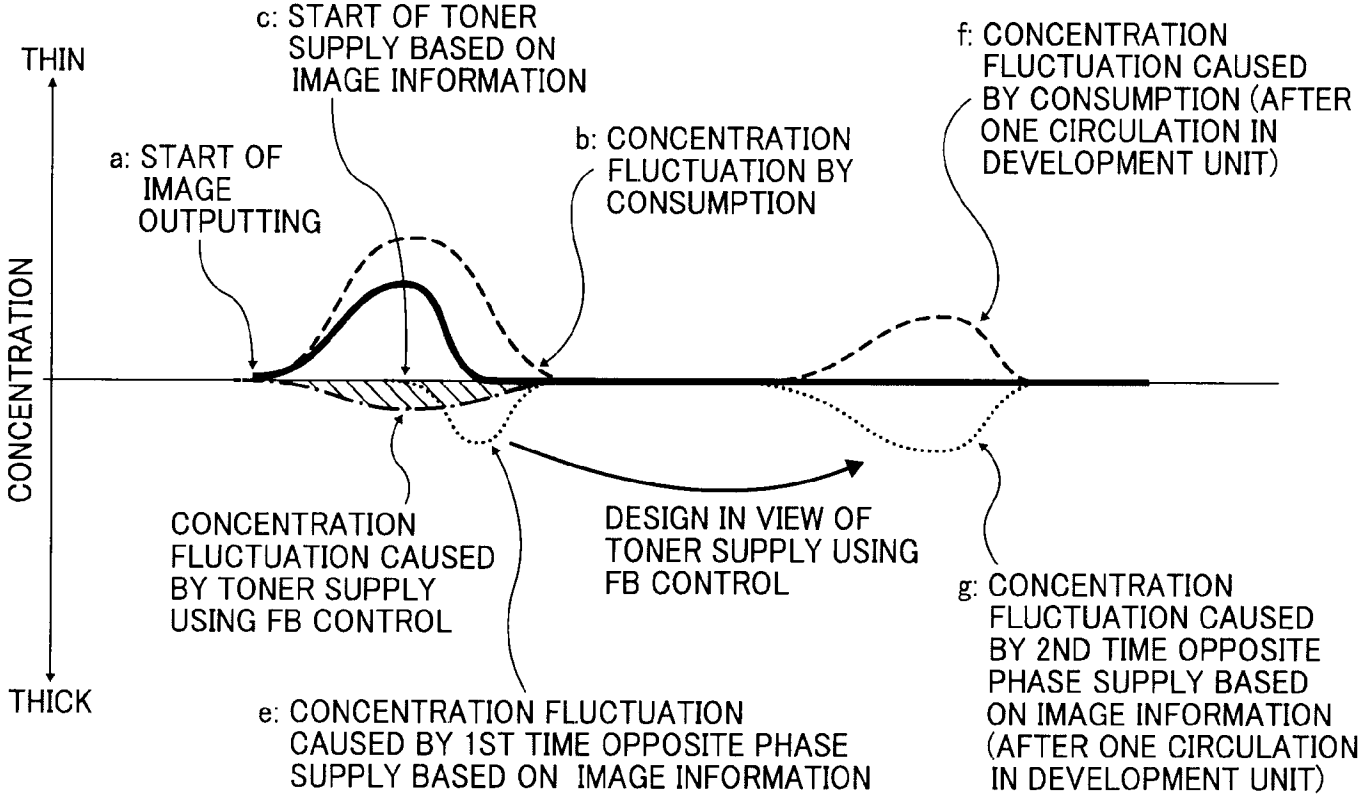
FIG. 17 shows a toner concentration fluctuation scheme, in which a toner supply operation based on image information can be conducted partially right after the toner consumption occurs by supplying toner with an amount corresponding to a part of image information that can be handled during the toner consumption timing, and then after circulating a developing agent having a toner consumption profile in a development unit for one circulation, a toner supply operation based on a remaining part of image information, which cannot be handled during the toner consumption timing, can be conducted as an opposite-phase toner supply operation in view of a toner supply amount by a feedback (FB) control conducted during the toner consumption timing, by which the toner consumption profile can be cancelled out, in which a toner supply timing and a toner consumption timing are shown.

A description is given of the toner supply amount and timing for the second example embodiment with reference to FIG. 17. FIG. 17 shows a case that the toner consumption profile, having the toner concentration fluctuation at the thin side, can be cancelled out by conducting an opposite-phase toner supply operation in view of the toner supply amount supplied by a feedback (FB) control after circulating the developing agent in the development unit 7 for a given distance such as one circulation in the development unit 7.

Specifically, as for the toner supply operation based on the second segment information of image information that can be conducted right after the toner consumption occurs, the toner supply operation is conducted by supplying a given amount of toner corresponding to the second segment information of image information, wherein the second segment information of image information can be handled right after the toner consumption occurs.

As for the toner supply operation based on the first segment information of image information that cannot be conducted right after the toner consumption occurs, the toner supply operation based on the first segment information and matched to the toner consumption area, caused by the toner consumption, can be conducted after circulating the developing agent in the development unit 7 for a given distance such as one circulation in the development unit 7.

In FIG. 17, a development process is started and a toner consumption starts from an image outputting start position indicated by "a." Then, the toner concentration becomes thin by the toner consumption (see "b" in FIG. 17), in which depending on a detection level by the toner concentration sensor 10, the FB control is activated to conduct a toner supply operation (see hatched area in FIG. 17).

Then, the toner supply operation based on the second segment information of image information can be conducted right after the toner consumption occurs, in which the toner supply amount matched to the second segment information, which is a part of the image information, can be supplied as a first time opposite-phase toner supply operation. In such a configuration, in addition to the toner supply operation using the FB control, the toner supply operation based on the second segment information of image information, which is a part of the image information, can be conducted (see a dot line indicated by "e" in FIG. 17), by which the toner concentration fluctuation caused by the toner consumption can be reduced (see a timing around "a, b, c, and e" in FIG. 17).

After circulating the developing agent for a given distance such as one circulation in the development unit 7, the toner concentration fluctuation at the thin side, caused by the toner consumption, also circulates the development unit 7 for one circulation, at which a second time opposite phase toner supply operation is conducted to cancel out the toner concentration fluctuation at the thin side. Because the developing agent circulates for one circulation with a given time duration after the toner consumption occurs at "b" (see FIG. 17), which may be enough for computing a toner supply amount and timing for the opposite-phase toner supply operation, it becomes easy to match the second time opposite phase toner supply operation with the toner concentration fluctuation at the thin side (see "f" and "g" in FIG. 17).

Further, when preparing the second time opposite-phase toner supply operation, the toner supply amount already supplied by the FB control and the toner supply amount by the first time opposite-phase toner supply operation are considered, by which the toner amount in the development unit 7 may not become an excessive toner condition, and thereby the toner supply operation to cancel out the thin toner condition can be conducted at a preferable timing with a preferable amount. Therefore, although the toner concentration fluctuation occurs at "b" in FIG. 17, the toner concentration fluctuation at the thin side (see "f" in FIG. 17) and the toner concentration fluctuation at the thick side (see "g" in FIG. 17) can cancel each other, by which the developing agent without toner concentration fluctuation can be set.

The toner supply control system for conducting the toner supply timing shown in FIG. 17 can be conducted using the block diagrams used for the first example embodiment (see FIGS. 12 to 14), and the configurations of FIGS. 12 to 14 can be used similarly, but the supply amount computing unit functions differently in the second example embodiment compared to the first example embodiment.

The supply amount computing unit computes a toner supply amount required for cancelling out the tone concentration fluctuation based on the input image information. Specifically, the supply amount computing unit computes a toner supply amount and timing for the first time opposite-phase toner supply operation using the second segment information, which is a part of the image information and can be handled right after the toner consumption occurs. Further, the supply amount computing unit computes a toner supply amount and timing for the second time opposite-phase toner supply operation using the first segment information, which is a part of the image information and cannot be handled right after the toner consumption occurs. The toner supply amount used for the second time opposite-phase toner supply operation can be computed by subtracting the toner supply amount, supplied by the first time opposite-phase toner supply operation, from the toner supply amount required for cancelling out the tone concentration fluctuation, which is determined based on the input image information. Because the toner supply operation using the FB control is also conducted right after the toner consumption occurs, an effect of the toner supply amount by the FB control is also incorporated when the toner supply amount used for the second time opposite-phase toner supply operation is computed.

As such, the supply amount computing unit computes the toner supply amount and timing for the first time opposite-phase toner supply operation, and then computes the toner supply amount and timing for the second time opposite-phase toner supply operation. The second time opposite-phase toner supply operation is conducted after circulating the developing agent in the development unit 7 for a given distance such as one circulation in the development unit 7.

In a case of FIG. 12, the toner supply amount by the FB control is incorporated by applying the gain 2, and then the toner supply amount is output. In a case of FIG. 13, the toner supply amount by the FB control is incorporated to the image information by applying the gain 3, and then the toner supply amount is output.

In a case of FIG. 14, because the toner supply amount by the FB control is output to the supply amount computing unit, parameters and/or reference tables used for computing the toner supply amount of the second time opposite-phase toner supply operation, which is to be conducted after one circulation in the development unit 7, may be changed in view of the toner supply amount value by the FB control, and then the toner supply amount incorporating the toner supply amount value by the FB control is output.

Further, the correction value output from the FB control can be applied to other portions not shown in FIGS. 12 to 14. Further, the gain can be set other portions not shown in FIGS. 12 to 14. Further, the systems shown in FIGS. 12 to 14 can be combined.

The second example embodiment uses such toner supply control system or method, in which the toner supply control system or method can set the target toner concentration with a high precision, and thereby images can be produced with high quality.

In the above described first and second example embodiments, the toner supply amount by the FB control may be considered when designing the toner supply control system and method. However, because the toner supply amount by the FB control changes depending on an output image area, the toner supply amount by the FB control can be ignored in some cases such as when the toner supply amount by the FB control is too small; when the toner supply amount by the FB control is set too small due to the mechanical properties; or when an integral parameter is great and a time constant is small for the FB controller.

Figure 18:
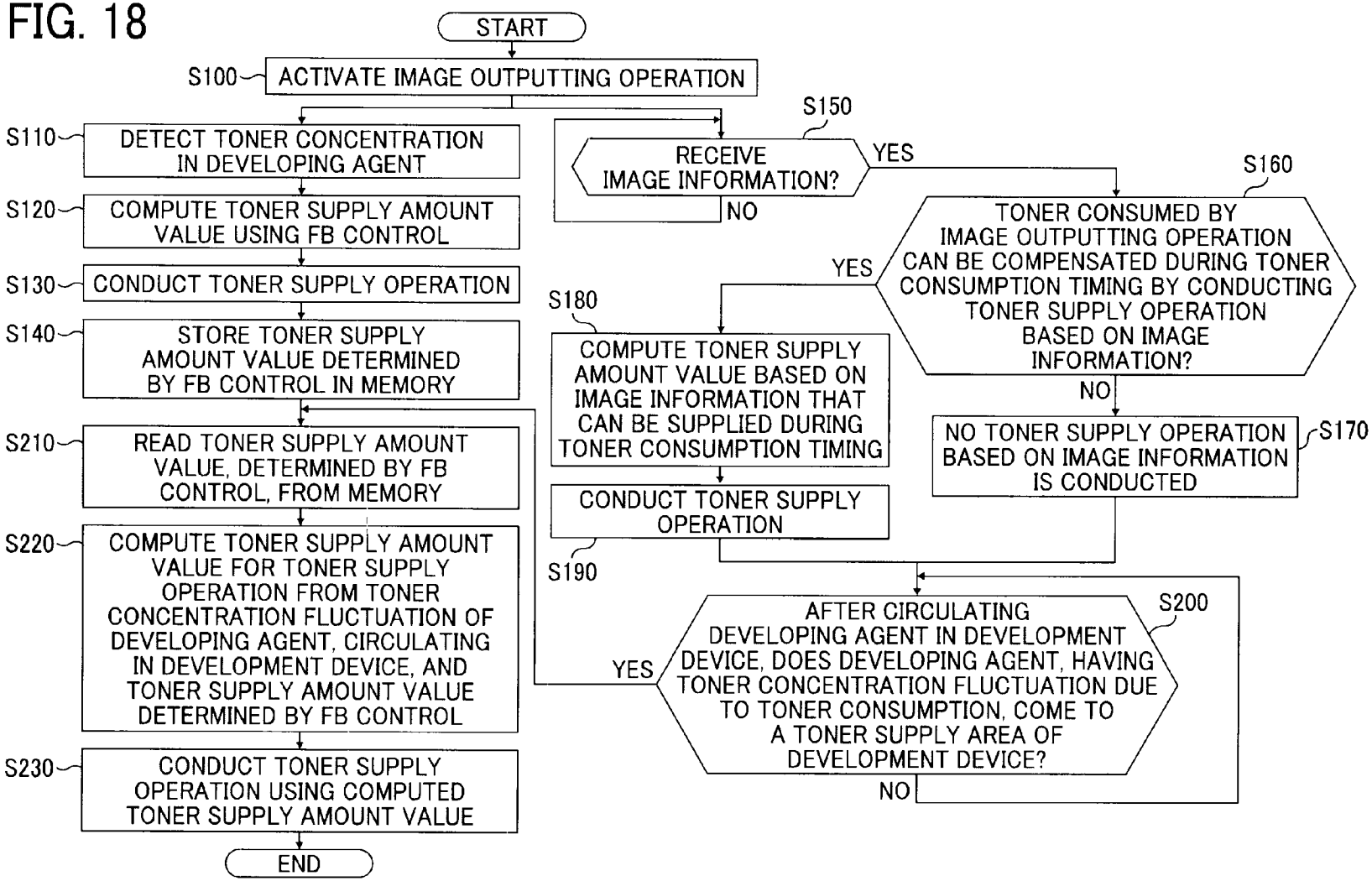
FIG. 18 shows a flowchart of process of toner supply operation according to example embodiments.

A description is given of the toner supply operation according to example embodiments with reference to FIG. 18, which shows a flowchart of steps in the process of toner supply, and FIGS. 11 and 17, showing example profiles of toner concentration fluctuations in the development unit 7 according to example embodiments.

When an image outputting operation such as a printing operation is initiated or activated at step S100 (see "a" in FIGS. 11 and 17), the toner concentration in the developing agent can be detected by the toner concentration sensor 10 at step S110, and the toner supply amount value is computed based on a detection result of the toner concentration sensor 10Y using a feedback (FB) control at step S120. Then, a toner supply operation using the toner supply amount value computed at step S120 is conducted at step S130 right after the toner consumption occurs (see hatched area in FIGS. 11 and 17). The toner supply amount value, computed at step S120 using the FB control, can be stored in a memory at step S140.

Further, when the image outputting operation is initiated or activated at step S100 (see "a" in FIGS. 11 and 17), it is determined whether image information, which is to be used for forming an image, is received by the control unit 100 at step S150. If it is determined that the image information is received by the control unit 100 (step S150: YES), the process proceeds to step S160.

At step S160, it is determined whether the toner consumed by image outputting operation can be replaced right after the toner consumption occurs by conducting a toner supply operation based on the image information, at least using the image information partially. If it is determined that the toner supply operation based on the image information cannot be conducted right after the toner consumption occurs (S160: No), the process proceeds to step S170, in which the toner supply operation based on the image information is not conducted right after the toner consumption occurs (see condition after "b" in FIG. 11).

If it is determined that the toner supply operation based on the image information can be conducted, at least using the image information partially, right after the toner consumption occurs (S160: Yes), the process proceeds to step S180, in which a toner supply amount value based on the image information, which can be supplied right after the toner consumption occurs, is computed. Then, a first time opposite phase toner supply operation using the toner supply amount value computed at S180 is conducted at step 190 (see "e" in FIG. 17). As shown at "e" in FIG. 17, right after the toner consumption occurs, the first time opposite phase toner supply operation can be conducted using the image information partially but a toner supply operation using entire image information cannot be conducted. When the first time opposite phase toner supply operation can be conducted as shown at "e" in FIG. 17, the toner supply operation using the toner supply amount value computed at step S120 using the FB control is also conducted (see step S130 in FIG. 18 and hatched area in FIG. 17).

After step S170 or step S190, the developing agent having toner consumed in the image forming operation circulates in the development unit 7Y, and the process proceeds to step S200.

In a case of using step 170, the process can proceed as shown by the profile of FIG. 11. At step S200, it is determined whether the developing agent, having the toner concentration fluctuation at the thin side caused by the toner consumption, comes to a toner supply area of the development unit 7 by circulating the developing agent in the development unit 7Y for a given distance such as one circulation in the development unit 7Y. If it is determined that such developing agent comes to the toner supply area of the development unit 7 again (step S200: YES), the toner supply amount value, determined by the FB control and stored in the memory (step 140) is read from the memory at step S210. Then, the control unit 100 computes a toner supply amount value for a toner supply operation using information of the toner concentration fluctuation (e.g., thin concentration of toner) of the developing agent, circulating in the development unit 7Y, and the toner supply amount value determined by the FB control (step 120), in which the image information is also used to compute a toner supply amount value for a toner supply operation to cancel out the toner concentration fluctuation of the developing agent. Then, a toner supply operation using the toner supply amount value computed at 5220 is conducted at step 230 (see "e1" in FIG. 11), at which an opposite phase toner supply is conducted using the toner supply amount value computed at S220. As shown at "e1" in FIG. 11, the opposite phase toner supply can be conducted to cancel out the toner concentration fluctuation (e.g., thin concentration of toner) of the developing agent, by which the developing agent without toner concentration fluctuation can be prepared and used for a subsequent image forming operation. Then, the toner supply control process ends.

In contrast, in a case of using steps 180 and 190, the process can proceed as shown by the profile of FIG. 17. At step S200, it is determined whether the developing agent, having the toner concentration fluctuation at the thin side caused by the toner consumption, comes to a toner supply area of the development unit 7 by circulating in the development unit 7Y for a given distance such as one circulation in the development unit 7Y. If it is determined that such developing agent comes to the toner supply area of the development unit 7 again (step S200: YES), the toner supply amount value, determined by the FB control and stored in the memory (step 140) is read from the memory at step S210. Then, the control unit 100 computes a toner supply amount value for a second time opposite phase toner supply operation using information of the toner concentration fluctuation (e.g., thin concentration of toner) of the developing agent, circulating in the development unit 7Y, and the toner supply amount value determined by the FB control (step 120), in which the image information is also used to compute a toner supply amount value for the second time opposite phase toner supply operation to cancel out the toner concentration fluctuation of the developing agent. Then, the second time opposite phase toner supply operation using the toner supply amount value computed at S220 is conducted at step 230 (see "g" in FIG. 17). As shown in "g" in FIG. 17, the second time opposite phase toner supply can be conducted to cancel out the toner concentration fluctuation (e.g., thin concentration of toner) of the developing agent, by which the developing agent without toner concentration fluctuation can be prepared and used for a subsequent image forming operation. Then, the toner supply control process ends.

In the above described example embodiments of the toner supply control system and method, toner concentration fluctuation in a developing agent can be cancelled out by conducting an opposite phase toner supply operation determined based on image information, to be used for forming an image, in which when a toner supply amount required for the opposite phase toner supply operation is computed based on the image information, and a toner supply amount determined by using a toner concentration detector is incorporated for computing the toner supply amount required for the opposite phase toner supply operation, by which a target toner concentration can be set with high precision. As above described, by supplying fresh toner to an exact portion of developing agent that has consumed toner for forming images, in the precise amount of toner consumed, high-quality image forming can be conducted.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps. Further, in the above-described exemplary embodiment, a storage device (or recording medium), which can store computer-readable program, may be a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, hard disk in a server, or the like, but not limited these. Further, a computer-readable program can be downloaded to a particular computer (e.g., personal computer) via a network such as the interne, or a computer-readable program can be installed to a particular computer from the above-mentioned storage device, by which the particular computer may be used for the system or apparatus according to an example embodiment, for example.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A toner supply control system for an image forming apparatus, the image forming apparatus including:

a latent image carrier;

a latent image forming device to form a latent image on the latent image carrier; and a development device to develop the latent image formed on the latent image carrier using a developing agent, the development device including:

a developing agent transporting device to transport the developing agent along a developing agent circulation route;

a developing agent carrying device to carry the developing agent, circulating in the developing agent circulation route, on a surface of the developing agent carrying device, and to transport the developing agent to a development area facing the latent image carrier, and to return the developing agent passing the development area to the developing agent circulation route again; and a toner supply device to supply toner to the developing agent circulating in the developing agent circulation route from a toner supply area set at a given position of the developing agent circulation route by driving a toner supply member using a drive force of a drive source, the toner supply control system to control a toner supply for the development device comprising:

a toner concentration detector, disposed at a position downstream in a transporting direction of the developing agent with respect to the toner supply area where the toner supply device supplies toner to the developing agent to detect toner concentration of the developing agent; and a supply controller to compute and adjust a toner supply amount value required for a toner supply operation to cancel a toner concentration fluctuation in the developing agent, the supply controller including:

an image-information-based consumption prediction unit to predict toner consumption amount based on image information used for forming an image by the latent image forming device;

a toner-concentration-based consumption prediction unit to predict toner consumption amount based on a detection result of the toner concentration detector; and a toner supply determination unit to determine a toner supply timing and a toner supply amount and initiate a toner supply operation based on the toner consumption amount predicted by the toner-concentration-based consumption prediction unit right after the toner consumption occurs, wherein when the developing agent, containing consumed toner corresponding to the image information, comes to the toner supply area of the toner supply device again after the toner consumption occurs, the toner supply determination unit initiates a toner supply operation using a toner supply amount computed by using the toner consumption amount predicted by the image-information-based consumption prediction unit in view of the toner consumption amount predicted by the toner-concentration-based consumption prediction unit.

2. The toner supply control system of claim 1, wherein the supply controller converts the toner consumption amount obtained from the toner-concentration-based consumption prediction unit to image information, and the supply controller adds the converted image information to the image information obtained from the image-information-based consumption prediction unit to compute the toner supply amount value for cancelling out toner concentration fluctuation in the developing agent.

3. The toner supply control system of claim 1, wherein the supply controller converts the toner supply amount information determined by the toner-concentration-based consumption prediction unit to the toner supply amount information incorporating timing information of toner supply operation while applying a gain value thereto, and the supply controller incorporates the toner supply amount information incorporating the timing information to toner supply amount information computed by the image-information-based consumption prediction unit to compute the toner supply amount value for cancelling out toner concentration fluctuation in the developing agent.

4. The toner supply control system of claim 1, wherein the supply controller converts the toner supply amount information, determined by the toner-concentration-based consumption prediction unit, to toner supply amount information incorporating the timing information of toner supply operation, and the supply controller incorporates the toner supply amount information, determined by the toner-concentration-based consumption prediction unit and incorporating the timing information, to toner supply amount information computed by the image-information-based consumption prediction unit while applying a gain value to compute the toner supply amount value for cancelling out toner concentration fluctuation in the developing agent.

5. An image forming apparatus, comprising:

the toner supply control system of claim 1, and a transfer device to transfer a toner image, developed by the development device by supplying toner to the latent image formed on the latent image carrier, to a recording medium.

6. A toner supply control system for an image forming apparatus, the image forming apparatus including:

a latent image carrier;

a latent image forming device to form a latent image on the latent image carrier; and a development device to develop the latent image formed on the latent image carrier using a developing agent, the development device including:

a developing agent transporting device to transport the developing agent along a developing agent circulation route;

a developing agent carrying device to carry the developing agent, circulating in the developing agent circulation route, on a surface of the developing agent carrying device, and to transport the developing agent to a development area facing the latent image carrier, and to return the developing agent passing the development area to the developing agent circulation route again; and a toner supply device to supply toner to the developing agent circulating in the developing agent circulation route from a toner supply area set at a given position of the developing agent circulation route by driving a toner supply member using a drive force of a drive source, the toner supply control system to control a toner supply to the development device comprising:

a toner concentration detector disposed at a position downstream in a transporting direction of the developing agent with respect to the toner supply area where the toner supply device supplies toner to the developing agent to detect a toner concentration of the developing agent; and a supply controller to compute and adjust a toner supply amount value required for a toner supply operation to cancel a toner concentration fluctuation in the developing agent, the supply controller including:

an image-information-based consumption prediction unit to predict toner consumption amount based on image information used for forming an image by the latent image forming device;

a toner-concentration-based consumption prediction unit to predict toner consumption amount based on a detection result of the toner concentration detector; and a toner supply determination unit to determine a toner supply timing and a toner supply amount, wherein the toner supply determination unit initiates a toner supply operation based on a toner consumption amount predicted by the toner-concentration-based consumption prediction unit at a timing right after the toner consumption occurs, wherein the toner supply determination unit initiates a toner supply operation using a toner supply amount, based on a toner consumption amount corresponding to partial image information at the timing right after the toner consumption occurs, wherein the toner supply determination unit initiates a toner supply operation by computing the a toner supply amount, corresponding to the remaining image information with respect to the partially image information in view of the toner supply amount corresponding to the toner consumption amount predicted by the toner-concentration-based consumption prediction unit when the developing agent, containing consumed toner corresponding to the image information, comes to the toner supply area of the toner supply device for the second time after the toner consumption occurs.

7. The toner supply control system of claim 6, wherein the image information is composed of first segment information and second segment information, the first segment information is not used for a toner supply operation right after the toner consumption occurs, and the second segment information is used for a toner supply operation right after the toner consumption occurs, wherein the supply controller computes a toner supply amount using the first segment information, and wherein the supply controller computes a toner supply amount, different from the toner supply amount computed using the first segment information, using the second segment information while adding the toner supply amount computed by using a detection result of the toner-concentration-based consumption prediction unit.

8. The toner supply control system of claim 7, wherein the supply controller computes the toner supply amount using the first segment information by incorporating timing information of toner supply operation, and the supply controller initiates a toner supply operation using the toner supply amount computed by using the first segment information when the developing agent comes to the toner supply area of the toner supply device again after the toner consumption occurs, and wherein the supply controller computes the toner supply amount using the second segment information by incorporating the toner supply amount computed by using the detection result of the toner-concentration-based consumption prediction unit, and the supply controller combines a toner supply operation using the toner supply amount computed by using the second segment information with a toner supply operation using the toner supply amount computed by using the detection result of the toner-concentration-based consumption prediction unit right after the toner consumption occurs.

9. An image forming apparatus, comprising:

the toner supply control system of claim 6, and a transfer device to transfer a toner image, developed by the development device by supplying toner to the latent image formed on the latent image carrier, to a recording medium.

10. A method of controlling a toner concentration of a developing agent in an image forming apparatus, the method comprising the steps of:

a) detecting a toner concentration of a developing agent in a development device by using a toner concentration detector;

b) computing a toner supply amount value using feedback (FB) control in response to the toner concentration detected at the a) detecting step;

c) conducting a feedback-based toner supply operation using the toner supply amount value computed at the b) computing step;

d) storing the toner supply amount value determined by the FB control in a memory;

e) receiving image information to be used for an image forming operation;

f) determining whether a toner supply operation to cancel, at least partially, a toner concentration fluctuation of the developing agent caused by a toner consumption, can be conducted using the image information partially, right after the toner consumption occurs;

g) computing a toner supply amount value for the toner supply operation if the f) determining step determines that the toner supply operation to cancel, at least partially, the toner concentration fluctuation of the developing agent, can be conducted using the image information partially, right after the toner consumption occurs;

h) conducting the toner supply operation using the toner supply amount value computed at the g) computing step right after the toner consumption occurs if the f) determining step determines that the toner supply operation using the image information partially can be conducted right after the toner consumption occurs;

i) confirming a timing that the developing agent, being circulated in the development device with a toner consumed condition, comes to a toner supply area of the development device again after the toner consumption occurs;

j) computing a toner supply amount value to cancel out the toner concentration fluctuation of the developing agent based on the image information received at the e) receiving step, and the toner supply amount value computed by using FB control at the b) computing step, and the toner supply amount value computed at the g) computing step if the g) computing step is conducted; and k) conducting a toner supply operation using the toner supply amount value computed at the j) computing step when the i) confirming steps confirms that the developing agent comes to the toner supply area of the development device again after the toner consumption occurs.

11. The method of claim 10, wherein the j) computing step computes the toner supply amount value by further incorporating agitation and diffusion effects of toner in the developing agent.

* * * * *